US010272632B2

(12) United States Patent
Awano et al.

(10) Patent No.: US 10,272,632 B2
(45) Date of Patent: Apr. 30, 2019

(54) BINDING MEMBER, BINDING APPARATUS, AND IMAGE PROCESSING SYSTEM

(71) Applicant: FUJI XEROX CO., LTD., Tokyo (JP)

(72) Inventors: Hiroaki Awano, Yokohama (JP); Yoshinori Nakano, Yokohama (JP); Takuya Makita, Yokohama (JP); Kojiro Tsutsumi, Yokohama (JP); Katsumi Harada, Yokohama (JP); Yasuhiro Kusumoto, Yokohama (JP); Hiroshi Hagiwara, Yokohama (JP); Emiko Shiraishi, Yokohama (JP); Junichi Hirota, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 115 days.

(21) Appl. No.: 15/225,105

(22) Filed: Aug. 1, 2016

(65) Prior Publication Data

US 2017/0282482 A1 Oct. 5, 2017

(30) Foreign Application Priority Data

Mar. 29, 2016 (JP) ..... 2016-066533

(51) Int. Cl.
*B31F 1/07* (2006.01)
*B31F 5/02* (2006.01)
(Continued)

(52) U.S. Cl.
CPC ..... *B31F 1/07* (2013.01); *B31F 5/02* (2013.01); *B41F 19/02* (2013.01); *B42B 5/00* (2013.01);
(Continued)

(58) Field of Classification Search
CPC ..... B31F 1/07; B31F 5/02; B31F 2201/0712; B42F 3/00; B65H 2301/43828;
(Continued)

(56) References Cited

U.S. PATENT DOCUMENTS 5,140,380 A 8/1992 Nakamura et al.
8,333,372 B2 * 12/2012 Awaya ..... B65H 37/04 270/58.07
(Continued)

FOREIGN PATENT DOCUMENTS

JP 2010184769 A 8/2010
JP 2010-274623 A 12/2010
(Continued)

OTHER PUBLICATIONS

Office Action dated May 30, 2017, by the Australian Patent Office in counterpart Australian Application No. 2016213763.

*Primary Examiner* — Leslie A Nicholson, III
(74) *Attorney, Agent, or Firm* — Sughrue Mion, PLLC

(57) ABSTRACT

A binding member is provided and includes: upper teeth having a tooth form configured to form a convex-concave portion on a recording material bundle; and lower teeth having a tooth form configured to form the convex-concave portion on the recording material bundle, and paired with the upper teeth. At least one of the upper teeth and the lower teeth includes: a first tooth row having a first tooth form having a first shape suitable for binding a first binding number of sheets; and a second tooth row having a second tooth form having a second shape suitable for binding a second binding number of sheets which is smaller than the first binding number of sheets.

13 Claims, 15 Drawing Sheets

(51) Int. Cl.

| | |
|---|---|
| ***B42B 5/00*** | (2006.01) |
| ***B65H 37/04*** | (2006.01) |
| ***B42F 3/00*** | (2006.01) |
| ***B41F 19/02*** | (2006.01) |
| ***B42C 1/12*** | (2006.01) |
| ***G03G 15/00*** | (2006.01) |

(52) U.S. Cl.
CPC ..... *B42C 1/12* (2013.01); *B42F 3/00* (2013.01); *B65H 37/04* (2013.01); *G03G 15/6541* (2013.01); *B31F 2201/0712* (2013.01); *B65H 2301/43828* (2013.01); *B65H 2301/51616* (2013.01); *B65H 2408/1222* (2013.01); *B65H 2801/27* (2013.01); *G03G 15/6544* (2013.01); *G03G 2215/00822* (2013.01); *G03G 2215/00852* (2013.01)

(58) Field of Classification Search
CPC ..... B65H 2301/51616; B41F 19/02; G03G 15/6544; G03G 2215/00852
USPC ..... 270/58.07, 58.08; 493/390
See application file for complete search history.

(56) References Cited

U.S. PATENT DOCUMENTS

| | | | | |
|---|---|---|---|---|
| 8,983,362 | B2 * | 3/2015 | Nakamura | B65H 37/04 270/58.08 |
| 9,254,621 | B2 * | 2/2016 | Takahashi | B42C 13/00 |
| 2010/0202814 | A1 | 8/2010 | Nakamura | |
| 2014/0161565 | A1 | 6/2014 | Obuchi et al. | |
| 2016/0107409 | A1 * | 4/2016 | Kubo | B31F 1/07 412/33 |
| 2017/0174465 | A1 * | 6/2017 | Morinaga | B31F 5/02 |
| 2017/0217239 | A1 * | 8/2017 | Suzuki | B42C 1/12 |

FOREIGN PATENT DOCUMENTS

| | | | | |
|---|---|---|---|---|
| JP | 5533122 | B2 | 6/2014 | |
| JP | 2014177319 | A | 9/2014 | |
| JP | 2015193481 | A | 11/2015 | |
| JP | 2017100402 | A * | 6/2017 | B31F 5/02 |
| WO | 2014068985 | A1 | 5/2014 | |

* cited by examiner

BINDING MEMBER, BINDING APPARATUS, AND IMAGE PROCESSING SYSTEM

CROSS-REFERENCE TO RELATED APPLICATIONS

This application is based on and claims priority under 35 USC 119 from Japanese Patent Application No. 2016-066533 filed on Mar. 29, 2016.

BACKGROUND

Technical Field

The present invention relates to a binding member, a binding apparatus, and an image processing system.

SUMMARY

An aspect of an exemplary embodiment of the present invention provides a binding member including:

upper teeth having a tooth form configured to form a convex-concave portion on a recording material bundle; and lower teeth having a tooth form configured to form the convex-concave portion on the recording material bundle, and paired with the upper teeth, in which at least one of the upper teeth and the lower teeth includes:

a first tooth row having a first tooth form having a first shape suitable for binding a first binding number of sheets; and a second tooth row having a second tooth form having a second shape suitable for binding a second binding number of sheets which is smaller than the first binding number of sheets.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described in detail with reference to the accompanying drawings.

Figure 1:
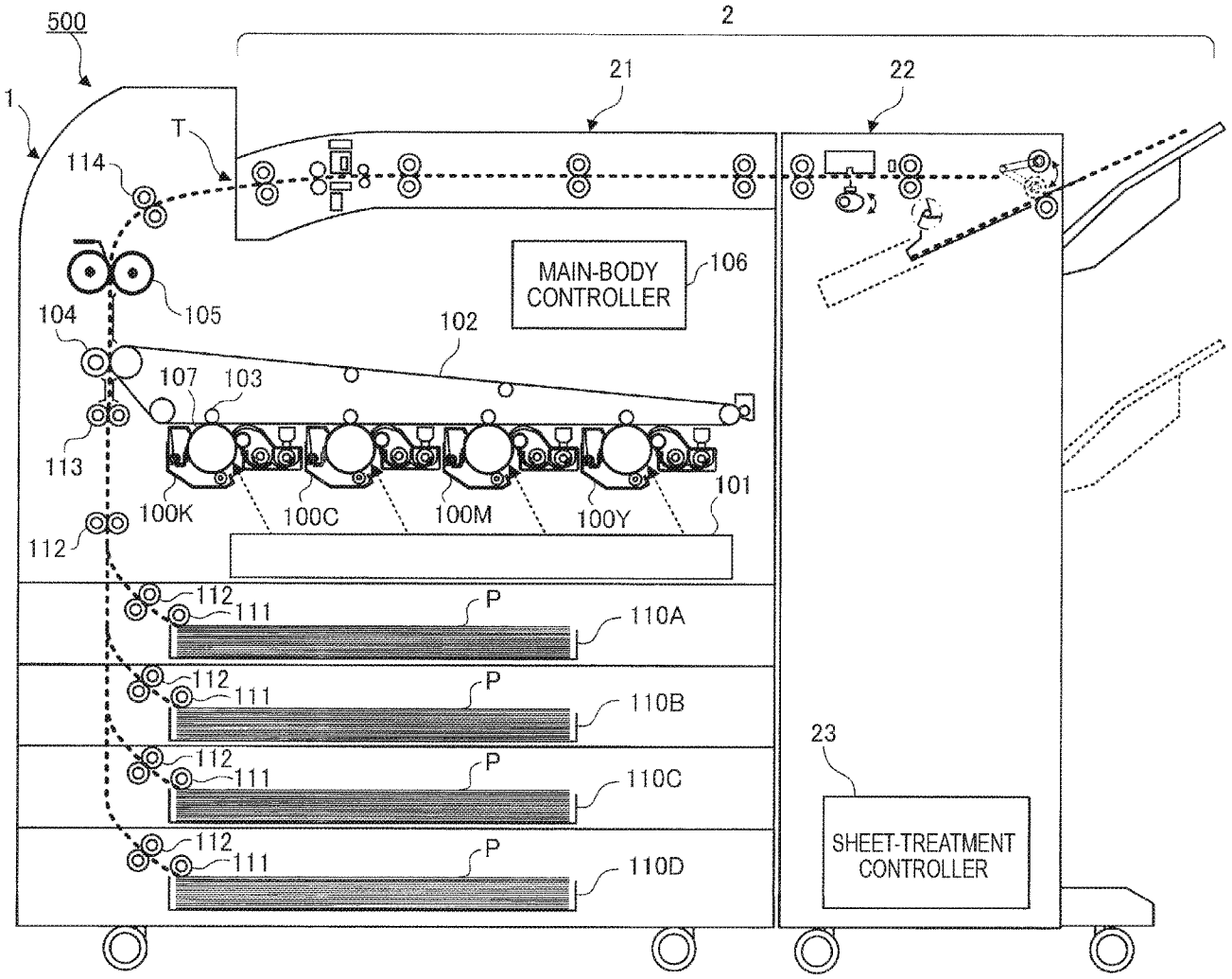
FIG. 1 is a view illustrating a configuration of a recording material processing system.

FIG. 1 is a view illustrating a configuration of a recording material processing system 500, to which an exemplary embodiment is applied.

The recording material processing system 500 functioning as a kind of an image processing system is provided with an image forming apparatus 1 that forms an image on a recording material (sheet) such as a sheet P using an electrophotographic method or the like in an image forming section, and a post-processing apparatus 2 that executes post processing on a plurality of sheets P on which the image has been formed by the image forming apparatus 1.

The image forming apparatus 1 includes four (4) image forming units 100Y, 100M, 100C, and 100K (which may be collectively referred to as "image forming units 100") that execute image formation based on individual color image data. Further, the image forming apparatus 1 is provided with a laser exposure unit 101 to expose a photoconductor drum 107 provided in each of the image forming units 100 so as to form an electrostatic latent image on a surface of the photoconductor drum 107.

The image forming apparatus 1 is also provided with an intermediate transfer belt 102 to which toner images of respective colors formed on the image forming units 100 are multiple-transferred, and primary transfer rolls 103 that sequentially transfer (primarily transfers) the toner images of respective colors formed on the image forming units 100 to the intermediate transfer belt 102. In addition, the image forming apparatus 1 is also provided with a secondary transfer roll 104 that batch-transfers (secondarily transfers), to the sheet P, toner images of colors transferred onto the intermediate transfer belt 102, a fixing device 105 that fixes the secondarily transferred toner images of colors to the sheet P, and a body controller 106 that controls an operation of the image forming apparatus 1.

In each of the image forming units 100, the charging of the photoconductor drum 107 and the formation of an electrostatic latent image on the photoconductor drum 107 are performed. Further, the development of the electrostatic latent image is performed so that the toner image of each color is formed on a surface of the photoconductor drum 107.

The toner images of respective colors formed on the surfaces of the photoconductor drums 107 are sequentially transferred to the intermediate transfer belt 102 by the primary transfer rolls 103. The toner images of respective colors are transported to a position where the secondary transfer roll 104 is installed according to the movement of the intermediate transfer belt 102.

Different sizes or different kinds of sheets P are accommodated in sheet accommodating units 110A to 110D of the image forming apparatus 1. In addition, for example, a sheet P is extracted from the sheet accommodating unit 110A by a pickup roll 111, and then is transported to a registration roll 113 by a transport roll 112.

In addition, in line with timing of transporting the toner images of respective colors on the intermediate transfer belt 102 to the secondary transfer roll 104, the sheet P is fed from the registration roll 113 to a facing unit (secondary transfer section) where the secondary transfer roll 104 faces the intermediate transfer belt 102.

The toner images of respective colors on the intermediate transfer belt 102 are electrostatically batch-transferred (secondarily transferred) to the sheet P by the action of a transfer electric field generated by the secondary transfer roll 104.

Subsequently, the sheet P to which the toner images of respective colors are transferred is released from the intermediate transfer belt 102 and then transported to the fixing device 105. The fixing device 105 fixes the toner images of respective colors onto the sheet P by a fixing process using heat and pressure so that an image is formed on the sheet P.

The sheet P formed with the image is discharged from a sheet discharge section T of the image forming apparatus 1 by the transport roll 114, and then fed to the post-processing apparatus 2 connected to the image forming apparatus 1.

The post-processing apparatus 2 is arranged on the downstream side of the sheet discharge section T of the image forming apparatus 1 to perform post-processing, such as punching or binding, on the sheet P formed with the image.

Figure 2:
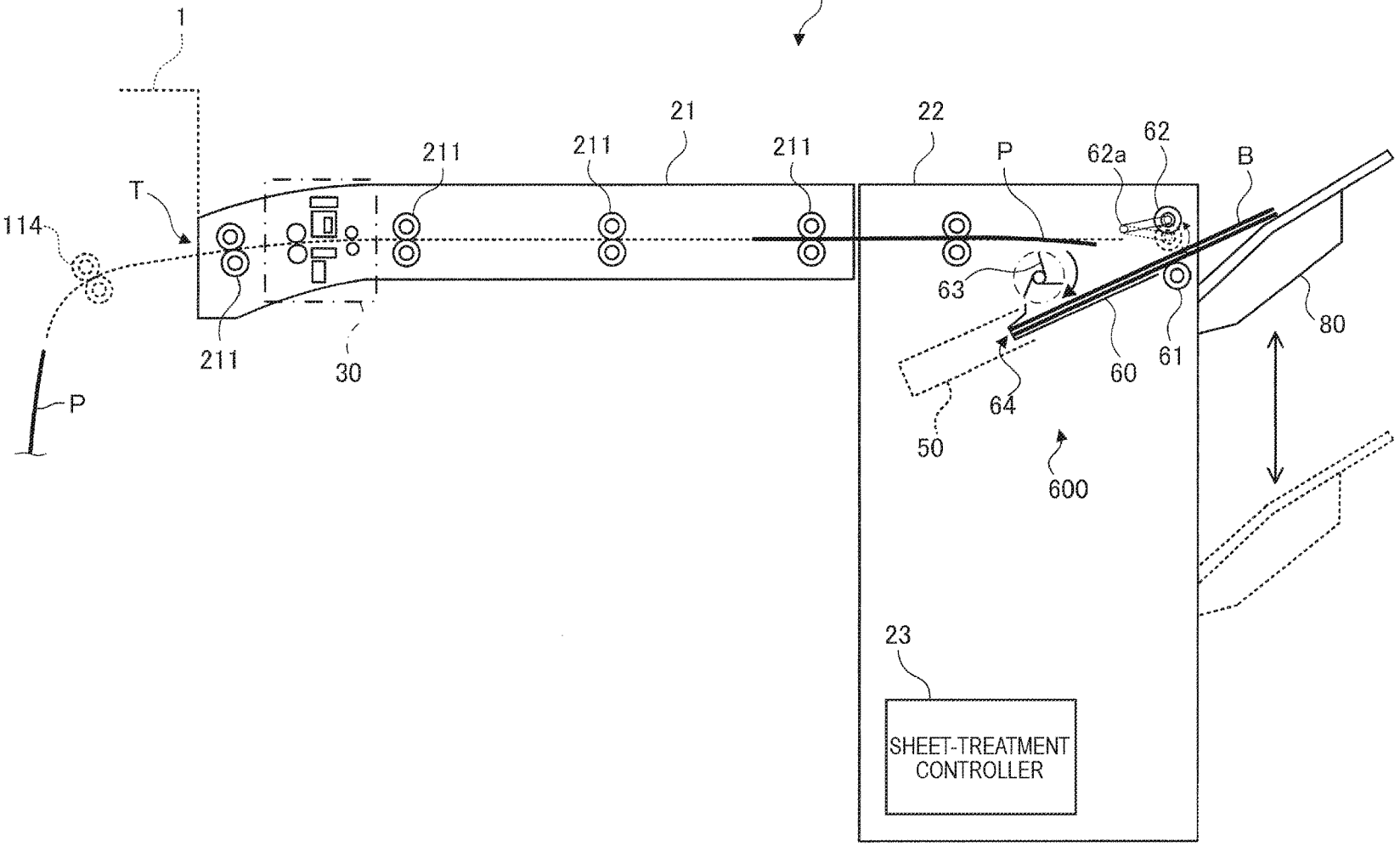
FIG. 2 is a view illustrating a configuration of a post-processing apparatus.

FIG. 2 is a view illustrating the configuration of the post-processing apparatus 2.

As illustrated in FIG. 2, the post-processing apparatus 2 includes a transport unit 21 connected to the sheet discharge section T of the image forming apparatus 1, and a finisher unit 22 that performs predetermined processing on the sheet P transported by the transport unit 21.

In addition, the post-processing apparatus 2 includes a sheet processing controller 23 to control each mechanism of the post-processing apparatus 2. The sheet processing controller 23 is connected to the body controller 106 (see FIG. 1) via a signal line (not shown) so as to performs transmission/reception of a control signal or the like.

The post-processing apparatus 2 includes a stacker unit 80 on which sheets P (sheet bundle B) on which processing by the post-processing apparatus has been terminated 2 are stacked.

As illustrated in FIG. 2, a punching section 30 is provided in the transport unit 21 of the post-processing apparatus 2 to punch two (2) holes or four (4) holes.

In addition, the transport unit 21 is provided with a plurality of transport rolls 211 to transport the sheet P, on which the image has been formed by the image forming apparatus 1, towards the finisher unit 22.

The finisher unit 22 is provided with a binding processing device 600 to execute binding processing on a sheet bundle B as an example of the recording material bundle. The binding processing device 600 according to the present exemplary embodiment functions as a binding unit, and performs the binding processing on the sheet bundle B without using a staple (needle).

The binding processing device 600 is provided with a sheet accumulating section 60 to accumulate only a required number of sheets P while simultaneously supporting the sheets P from the underside so as to produce the sheet bundle B. Further, the binding processing device 600 is provided with a binding unit 50 to bind the sheet bundle B. The sheet accumulating section 60 functions as one holding unit to hold the sheet bundle B that is a recording material bundle.

The present exemplary embodiment performs binding processing on the sheet bundle B by pressing advancement members (to be described later) provided in the binding unit 50 to the sheet bundle B from the both sides of the sheet bundle B so that the sheets P constituting the sheet bundle B are press-bonded to each other [cause the fibers forming the sheets P to be entangled], thereby binding the sheet bundle B.

Also, the binding processing device 600 is provided with a take-out roll 61 and a moving roll 62. The take-out roll 61 rotates in a clockwise direction in the drawing so as to send the sheet bundle B on the sheet accumulating section 60 to the stacker unit 80.

The moving roll 62 is provided to be movable around a rotating shaft 62*a*, and is located at a position retracted from the take-out roll 61 when the sheets P are accumulated in the sheet accumulating section 60. Further, when the produced sheet bundle B is sent to the stacker unit 80, the moving roll 62 is pressed against the sheet bundle B on the sheet accumulating section 60.

The processing performed by the post-processing apparatus 2 will be described.

In the present exemplary embodiment, an instruction signal indicating execution of processing for a sheet P is outputted from the body controller 106 to the sheet processing controller 23. The sheet processing controller 23 receives the instruction signal, and the post-processing apparatus 2 performs the processing on the sheet P.

In the processing of the post-processing apparatus 2, first, a sheet p on which image formation has been performed by the image forming apparatus 1 is fed to the transport unit 21 of the post-processing apparatus 2. In the transport unit 21, punching is performed by the punching section 30 in response to the instruction signal from the sheet processing controller 23, and then the sheet P is transported towards the finisher unit 22 by the transport roll 211.

When there is no instruction to perform the punching from the sheet processing controller 23, the sheet P is delivered to the finisher unit 22 in a state where the punching processing is not performed by the punching section 30.

The sheet P sent to the finisher unit 22 is transported to the sheet accumulating section 60 that is provided in the binding processing device 600. The sheet P is slid over the sheet accumulating section 60 due to an inclination angle imparted to the sheet accumulating section 60, and thereby comes into contact with a sheet regulating section 64 provided on an end of the sheet accumulating section 60.

Thus, the sheet P stops moving. In the present exemplary embodiment, the sheet P comes into contact with the sheet regulating section 64, so that the sheet bundle B is produced on the sheet accumulating section 60 with rear ends of the sheets P being evenly arranged. Further, in the present exemplary embodiment, a rotary paddle 63 is provided to move the sheets P towards the sheet regulating section 64.

Figure 3:
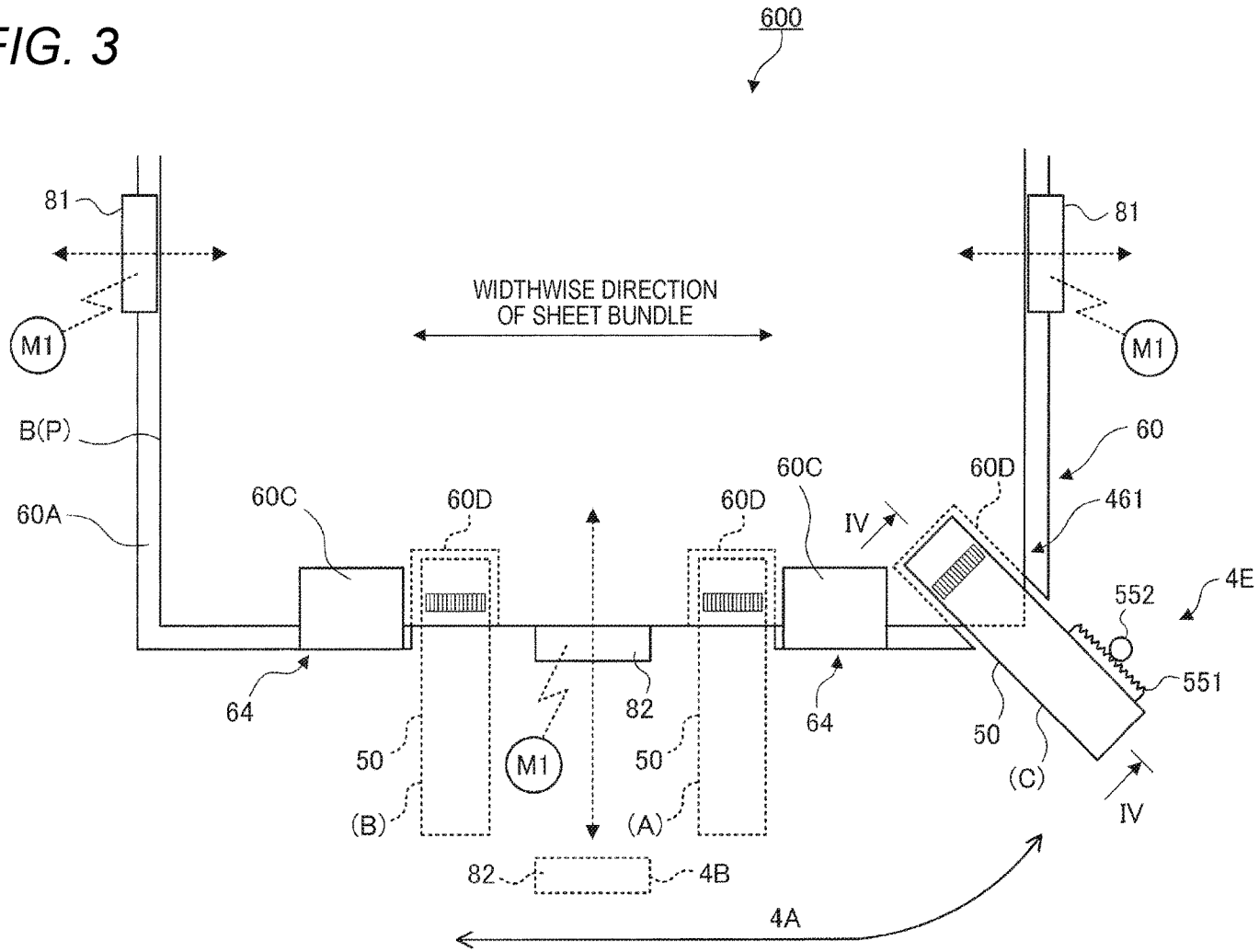
FIG. 3 is a view illustrating a binding processing device when seen from the top side.

FIG. 3 is a view illustrating a binding processing device 600 when viewed from the top side.

First moving members 81 are provided on opposite ends of the sheet accumulating section 60 in a widthwise direction thereof.

The first moving members 81 are pressed against the sides of the sheets P constituting the sheet bundle B, thereby aligning the ends of the sheets P of the sheet bundle B. Further, the first moving members 81 moves in the widthwise direction of the sheet bundle B so as to move the sheet bundle B in the widthwise direction of the sheet bundle B.

More specifically, in the present exemplary embodiment, when the sheets P are accumulated in the sheet accumulating section 60, the first moving members 81 are pressed against the sides of the sheets P so that the sides of the sheets P are aligned.

In addition, as will be described later, when the binding position of the sheet bundle B is changed, the sheet bundle B is pressed by the first moving members 81 to be moved in the widthwise direction of the sheet bundle B.

In addition, the binding processing device 600 of the present exemplary embodiment is provided with a second moving member 82.

The second moving member 82 moves in the up-down direction of the drawing so as to move the sheet bundle B in a direction perpendicular to the widthwise direction of the sheet bundle B.

In the present exemplary embodiment, the binding processing device 600 is also provided with a moving motor M1 to move both the first and second moving members 81 and 82.

As shown by arrow 4A of FIG. 3, the binding unit 50 is provided to be movable in the widthwise direction of the sheets P. The binding unit 50 performs binding processing ((2-point binding processing) on, for example, two points (position A and position B) located at different positions in the widthwise direction of the sheet bundle B.

In addition, the binding unit 50 moves to position C of FIG. 3 and performs binding processing (1-point binding) on corner of the sheet bundle B.

Further, the binding unit 50 moves linearly between position A and position B, whereas the binding unit 50 moves between position A and position C while performing, for example, a 45° rotation.

The sheet regulating section 64 is formed in a U-shape. A regulating section (not illustrated) is provided in the inside of the U-shape to extend upwards from a bottom plate 60A, and comes into contact with the tip end of a transported sheet P in the regulating section so as to regulate the movement of the sheet P. The sheet regulating section 64 formed in the U-shape has a facing unit 60C that is disposed to face the bottom plate 60A. This facing unit 60C comes into contact with the uppermost sheet P of the sheet bundle B to regulate the movement of the sheet P in a thickness direction of the sheet bundle B.

In the present exemplary embodiment, the binding processing is performed by the binding unit 50 at a position where the sheet regulating section 64 or the second moving member 82 is not installed.

More specifically, as illustrated in FIG. 3, the binding processing is performed by the binding unit 50 between the sheet regulating section 64 located on the left of the drawing and the second moving member 82, and between the sheet regulating section 64 located on the right of the drawing and the second moving member 82. Further, in the present exemplary embodiment, the binding processing is performed at a position adjacent to the sheet regulating section 64 located on the right of the drawing (at a corner of the sheet bundle B).

In addition, as illustrated in FIG. 3, three (3) notches 60D are formed in the bottom plate 60A. By this, it is possible to avoid interference between the sheet accumulating section 60 and the binding unit 50.

In the present exemplary embodiment, when the binding unit 50 moves, the second moving member 82 moves to a position denoted by reference numeral 4B in FIG. 3. Thus, it is possible to avoid interference between the binding unit 50 and the second moving member 82.

Figure 4A:
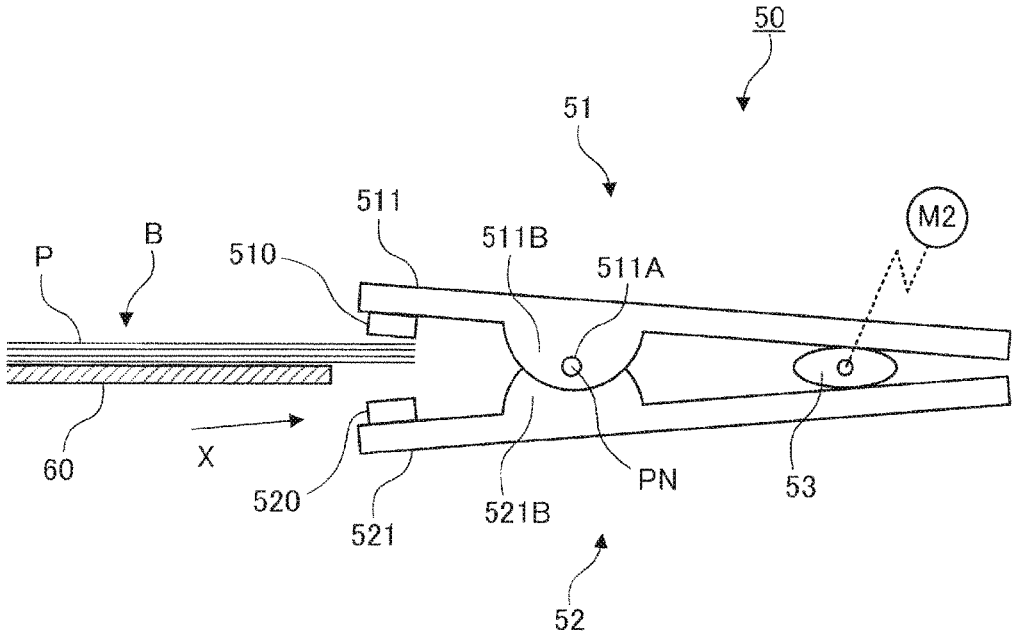
FIGS. 4A and 4B are sectional views taken along line IV-IV of FIG. 3.
Figure 4B:
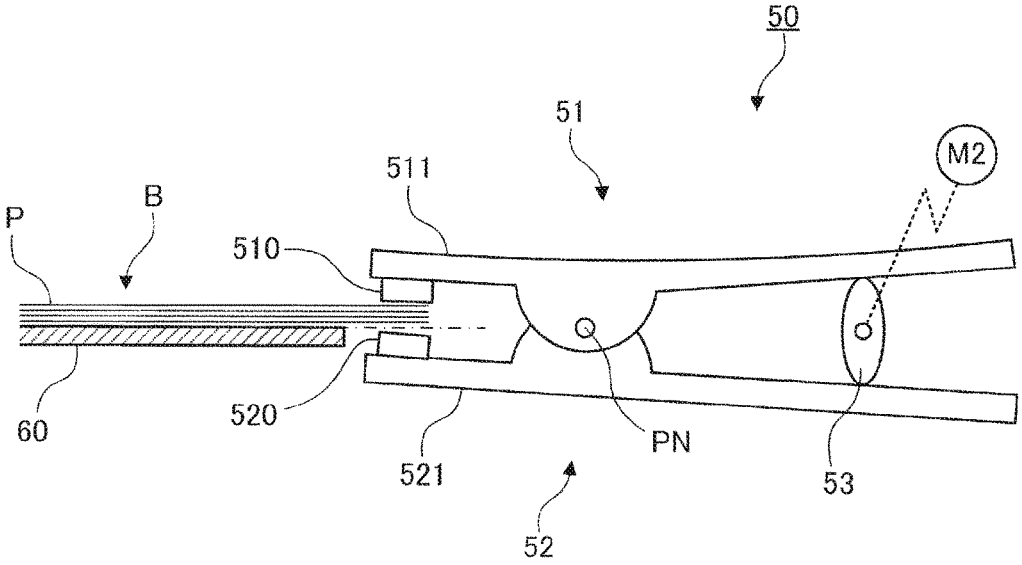

FIGS. 4A and 4B are sectional views taken along line IV-IV of FIG. 3.

As illustrated in FIG. 4A, the binding unit 50 includes a first driving section 51 extending in the left-right direction of the drawing, a second driving section 52 extending in the left-right direction of the drawing, and a cam motor M2 driving an elliptical cam 53 disposed between the first and second driving sections 51 and 52.

The first driving section 51 is provided with a driving piece 511. The driving piece 511 is formed in a plate shape to have one end at the sheet bundle B side and the other end at the side opposite to the one end.

In the present exemplary embodiment, upper teeth 510 are attached to the one end of the driving piece 511. The upper teeth 510 advance from one surface side of the sheet bundle B towards the sheet bundle B to press the sheet bundle B. Further, a protrusion 511B is provided on the driving piece 511 to protrude towards the second driving section 52 side, and a through hole 511A is formed in the protrusion 511B.

As illustrated in FIG. 4A, the second driving section 52 has a driving piece 521.

The driving piece 521 is formed in a plate shape to have one end at the sheet bundle B side and the other end at a side opposite to the one end. According to the present exemplary embodiment, lower teeth 520 are attached to the one end of the driving piece 521. The lower teeth 520 advance towards the other side of the sheet bundle B to press the sheet bundle B.

Further, a protrusion 521B is provided on the driving piece 521 to protrude towards the first driving section 51 side, and the protrusion 512 is formed with a through hole (located behind the through hole 511A of the first driving section 51 and not illustrated).

In addition, in the present exemplary embodiment, a pin PN is inserted into the through hole 511A formed in the first driving section 51 and the through hole (not illustrated) formed in the second driving section 52. In the present exemplary embodiment, the driving piece 511 and the driving piece 521 rock around the pin PN.

Further, in the present exemplary embodiment, the upper and lower teeth 510 and 520 are provided nearer to the sheet bundle B side than the pin PN, and the cam 53 is provided on the side opposite to the side into which the pin PN is fitted and on which the sheet bundle B is placed.

In the present exemplary embodiment, when the cam 53 is rotated by the cam motor M2, the upper and lower teeth 510 and 520 move close to each other, as illustrated in FIG. 4B, so that the sheet bundle B is sandwiched between the upper and lower teeth 510 and 520 and pressure is exerted on the sheet bundle B. Thus, fibers of the sheets P of the sheet bundle B are entangled, so that neighboring sheets P are bonded to each other, thereby producing a sheet bundle B subjected to the binding processing is produced. In the present exemplary embodiment, the structure having the upper and lower teeth 510 and 520 functions as one binding member. The binding unit 50 illustrated in FIGS. 4A and 4B may be understood as one binding member.

Here, a relationship between the size of the tooth of the binding member and the sheet bundle B will be described.

Figure 5A:
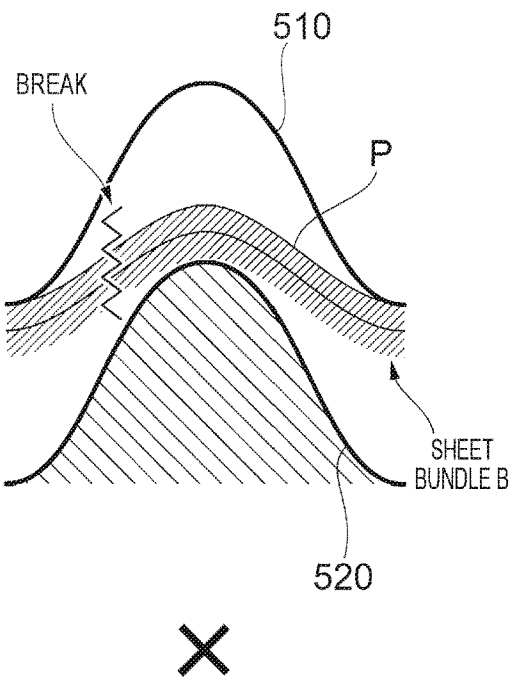
FIGS. 5A to 5C are views for describing a relationship between a size of a tooth form and a thickness of a sheet bundle.
Figure 5B:
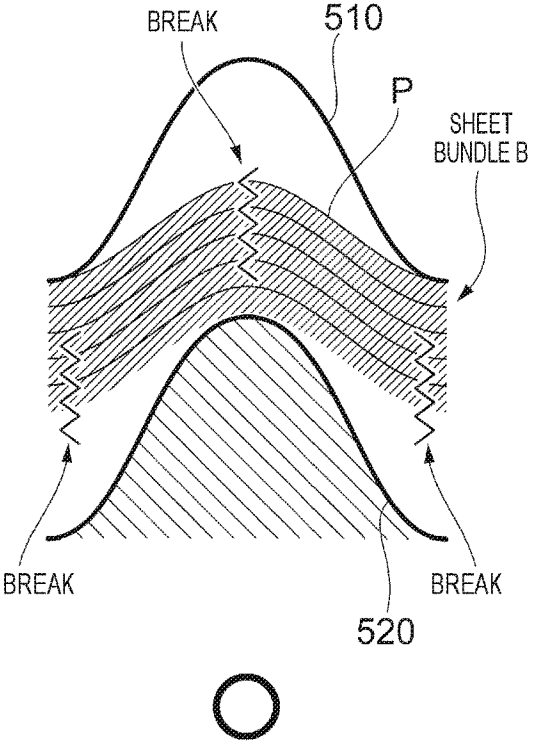
Figure 5C:
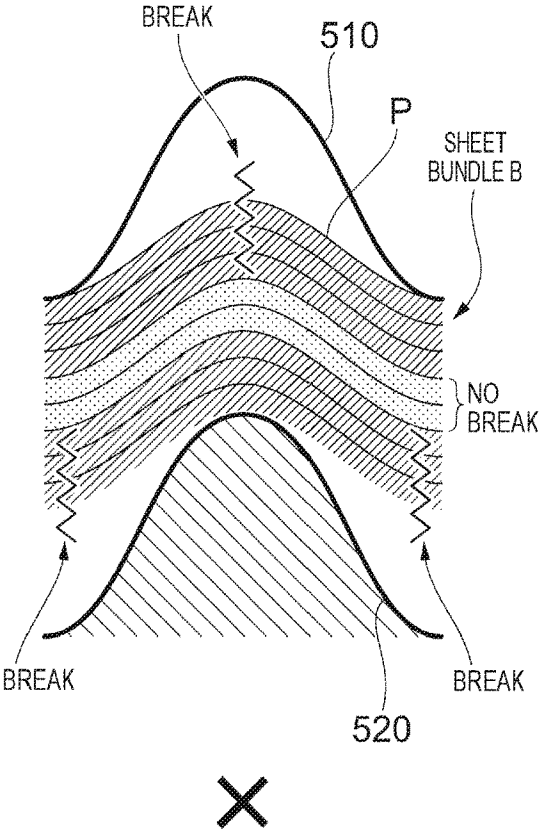

FIGS. 5A to 5C are views for describing a relationship between a size of a tooth form and a thickness of a sheet bundle B. FIG. 5A illustrates a case where the sheet bundle B is thin, compared to the size of the tooth form, FIG. 5B illustrates a case where the thickness of the sheet bundle B is adapted to for the size of the tooth form, and FIG. 5C illustrates a case where the sheet bundle B is thick, compared to the size of the tooth form.

The size of tooth form of the binding member that is operated by the upper and lower teeth 510 and 520 is related to adhesion that is a binding property of the sheet bundle B. In an example illustrated in FIG. 5A, since the sheet bundle B is thin compared to the size of the tooth form, the elongation of the sheet P exceeds a break point before the sheet P comes in close contact with the surface of the tooth so that the sheet P is broken at an unfixed position. Since the sheets are ruptured before a high load acts on the upper and lower teeth 510 and 520 to press the sheet bundle B, namely, before tension is applied to the sheets P, the slackness of a bound portion is remarkable when tension is applied so that it is impossible to obtain a stable binding force.

In an example illustrated in FIG. 5C, since the sheet bundle B is thick compared to the size of the tooth form, the sheets P located at the central portion of the sheet bundle B are not broken even after a high load acts on the upper and lower teeth 510 and 520 to press the sheet bundle B, and the sheets are released around the central portion of the sheet bundle B when tension is applied. Thus, it is impossible to obtain a stable binding force.

Meanwhile, in an example illustrated in FIG. 5B, since the thickness of the sheet bundle B is adapted to the size of the tooth form, the sheet bundle B comes into close contact with an inclined surface of the tooth and then is broken. That is, after the sheet bundle comes into close contact with the inclined surface of the tooth, all the sheets P of the sheet bundle B are broken in either of the front and rear sides so that fibers are entangled to bind the sheets P. Therefore, it is possible to obtain a stable binding force.

As described above, there is a close connection between the size of a tooth form and the thickness of a sheet bundle B. Thus, when it is desired to handle both a small number of sheets and a large number of sheets using a single device (e.g., binding processing device 600), complicated handling (such as preparing a plurality of kinds of binding members and changing the binding members depending on the number of sheets) is required.

However, the present exemplary embodiment handles the problems described above by providing a binding member having both an elongation amount region for a small number (e.g., two (2)) of sheets P (in which a small number of sheets is excellently in close contact with each other) and an elongation amount region for a large number (e.g., ten (10)) of sheets P (in which a large number of sheets are excellently in close contact with each other). More specifically, a plurality of teeth with adjusted tip ends R is arranged in at least one side of the upper teeth 510 and the lower teeth 520 of a single binding member in order to provide a binding member that handles both a small number of sheets and a large number of sheets.

Figure 6A:
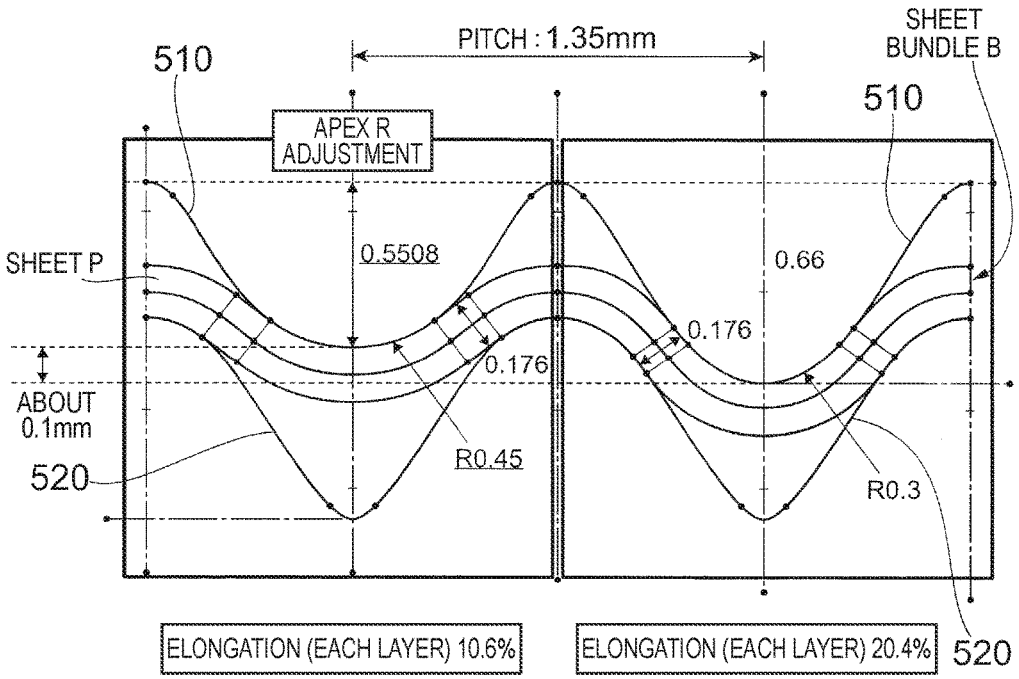
FIGS. 6A and 6B are views for describing a relationship between a cut quantity of a tip end R of a tooth and press-bonding.
Figure 6B:
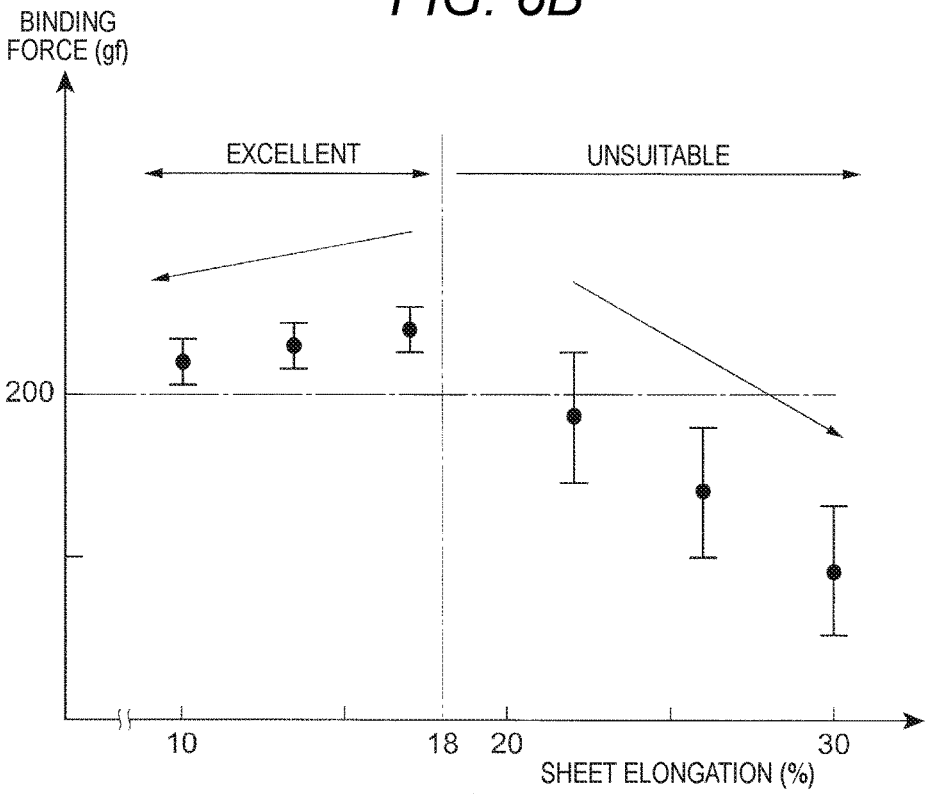

FIGS. 6A and 6B are views for describing a relationship between a cut quantity of a tip end R of a tooth and press-bonding. FIG. 6A is a view for describing a relationship between a shape of the tip end R and an elongation, and FIG. 6B is a diagram for describing a relationship between an elongation of sheets P and a press-bonded state of a sheet bundle B. In FIG. 6A, the sheet bundle B composed of a small number of sheets, namely, two sheets P is bound by the binding member. The right side of FIG. 6A illustrates a state where the upper and lower teeth 510 and 520 are not cut, and the left side of FIG. 6A illustrates a state where the upper teeth 510 are cut so that the surface length of the teeth is short. In the upper teeth 510 on the right side of FIG. 6A, the height of the tooth is 0.66 mm and a value of the tip end R is R 0.3. The upper teeth 510 on the left side of FIG. 6A are cut at the tip end R by about 0.1 mm compared to that on the right side so that the height is 0.5508 mm and a value of the tip end R is R 0.45. The upper and lower teeth 510 and 520 illustrated in FIG. 6A are 1.35 mm in pitch, and the thickness of the sheet bundle B are 0.176 mm. In the example illustrated on the right side of FIG. 6A, the elongation of the sheet P of each layer forming the sheet bundle B is 20.4%. Meanwhile, in the example illustrated on the left of FIG. 6A, the elongation of the sheet P of each layer forming the sheet bundle B is 10.6%.

In FIG. 6B, the horizontal axis represents an elongation (%) of a sheet P, while the vertical axis represents a binding force (gf) of a sheet bundle B. Assuming that a target value of compressive binding is 200 gf, the sheet elongation at which the binding force is stabilized is 18% in upper threshold. In a region where the elongation of the sheet P is higher than 18%, it is difficult to obtain the binding force exceeding 200 gf. Here, the term "binding force" means a force that can be withstood by a compression portion.

The state illustrated on the right side of FIG. 6A is an "unsuitable" state in which the sheet elongation of FIG. 6B is greater than 18%. In this state, before the sheets P comes into close contact with the inclined surface of the tooth, breakage occurs at an unfixed position so that an average binding force is lower than the target value of 200 gf and thus a stable binding force may not be obtained. Further, in the "unsuitable" state where the sheet elongation of FIG. 6B is greater than 18%, the number of breakage increases before the sheets comes into close contact with the inclined surface as the sheet elongation is increased. Therefore, a substantial elongation amount is reduced so that the binding force is considerably reduced.

Meanwhile, the state illustrated on the left side of FIG. 6A is a "good" state in which the sheet elongation of FIG. 6B is smaller than 18%. In this state, after the sheets P come into close contact with the inclined surface of the tooth, breakage occurs so that all the sheets P of the sheet bundle B break at either the outside or the inside. In this case, the average binding force exceeds the target value of 200 gf so that it is possible to obtain the stable binding force. In the "good" state in which the sheet elongation of FIG. 6B is smaller than 18%, when the sheet elongation is reduced, the elongation amount of the sheets P is likewise reduced. Thus, the binding force is lowered, but is slowly lowered. Further, fluctuation in binding force is also lower than that in the "unsuitable" state. In the example illustrated on the left side of FIG. 6A, the tooth illustrated on the right side of FIG. 6A is by about 0.1 mm so as to reduce the surface length of the tooth to be shorter than the tooth illustrated on the right of FIG. 6A. Therefore, it becomes apparent that the sheet elongation may become lower than 18% that is a preferred threshold. In addition, the results illustrated in FIGS. 6A and 6B are one example with certain sheets P under certain pressing conditions (speed, force, etc.), and the binding force or the threshold of the sheet elongation varies depending on the conditions.

In the present exemplary embodiment, the elongation amount region for a large number of sheets P and the elongation amount region for a small number of sheets P in which the tip end of the tooth is cut to increase the tip end R and to shorten the surface length of the tooth is shortened are provided in one binding member.

Hereinafter, embodiments will be described based on a difference in a way of having these regions.

First Exemplary Embodiment

Next, a first exemplary embodiment of the binding member to which the present exemplary embodiment is applied will be described.

Figure 7A:
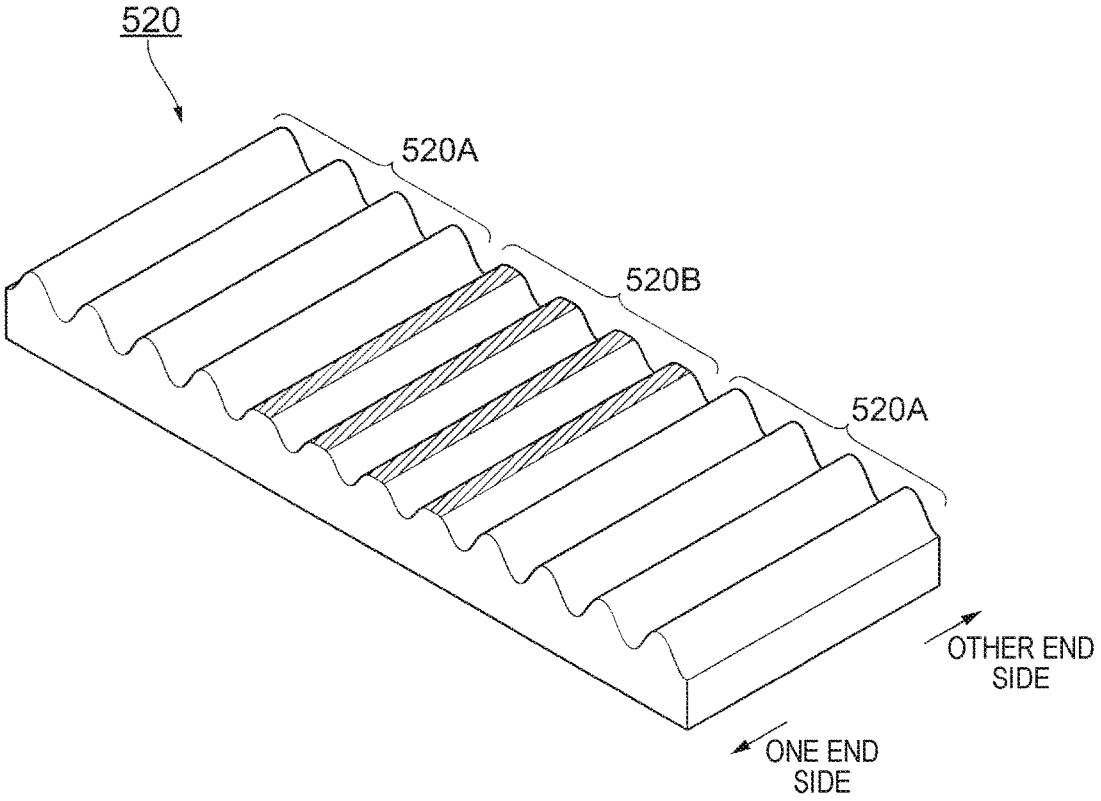
FIGS. 7A and 7B are views for describing a configuration of lower teeth constituting a binding member.
Figure 7B:
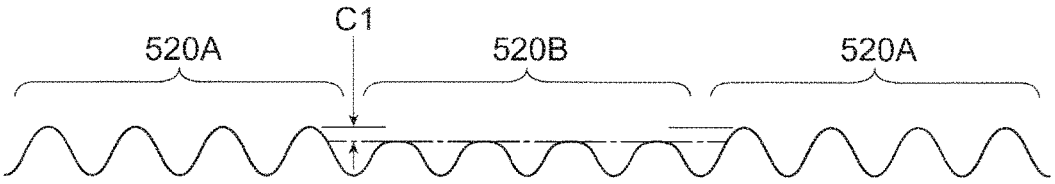

FIGS. 7A and 7B are views illustrating the configuration of the lower teeth 520 constituting the binding member. FIG. 7A is a perspective view of the lower teeth 520, and FIG. 7B is a view of the lower teeth 520 when viewed from one end side. In FIG. 6A, the elongation amount is adjusted by the upper teeth 510. However, in FIGS. 7A and 7B, a structure for adjusting the elongation amount is applied to the lower teeth 520.

As illustrated in FIG. 7A, the lower teeth 520 have a first tooth row 520A that is a row of teeth, each of which has a first tooth form having a shape determined to be suitable for a first binding number of sheets of a sheet bundle B (i.e., a first shape suitable for binding a first binding number of sheets). In addition, the lower teeth 520 have a second tooth row 520B that is a row of teeth, each of which has a second tooth form having a shape determined to be suitable for the second binding number of sheets (i.e., a second shape suitable for binding a second binding number of sheets), which is smaller than the first binding number of sheets. As the first binding number of sheets, for example, 6 to 10 sheets may be selected while as the second binding number of sheets, for example, 2 to 5 sheets may be selected.

In the examples illustrated in FIGS. 7A and 7B, first tooth rows 520A are disposed at both sides with the second tooth row 520B being interposed therebetween. In each of the first tooth rows 520A, four teeth each of which has a first tooth form, are aligned to form a tooth row. Further, in the second tooth row 520B, four teeth, each of which has a second tooth form, are aligned to form a tooth row. In order to secure a stable binding force, four or more teeth having the same tooth form may be successive.

As illustrated in FIG. 7B, the teeth constituting the second tooth row 520B are lower in height than that of the teeth constituting the first tooth rows 520A, by C1. Here, the second tooth form of the teeth constituting the second tooth row 520B is configured to be lower in height, by C1, than the first tooth form of the teeth constituting the first tooth rows 520A, by cutting only the tip end R of each tooth while leaving a positional relationship of the inclined surfaces of the teeth as it is. By this, the second tooth form becomes smaller in surface length than the first tooth form without changing the positional relationship of the inclined surfaces of the first tooth form. That is, the lower teeth 520 is provided with the first tooth rows 520A having the small tip end R in order to make the elongation amount of the sheets large, and the second tooth row 520B having the large tip end R to in order to make the elongation amount of the sheets small. The second tooth row 520B is in the state illustrated in the left side of FIG. 6A and the left side of FIG. 6B, so that it is possible to achieve excellent binding, for example, when the number of sheets P constituting the sheet bundle B is small (e.g., about two (2) sheets) and the sheet elongation is 18% or less. Meanwhile, the first tooth rows 520A has a tooth form that is preferred when the number of sheets P constituting the sheet bundle B is large (e.g., more than two (2) sheets), and is capable of forming excellent binding, as illustrated in FIG. 5B, in the sheet bundle B having a large number of sheets.

In the first exemplary embodiment, the respective teeth constituting the first tooth row 520A and the second tooth row 520B extend in the same shape as the shape illustrated in FIG. 7B from one end side to the other end side of the tooth extending in one direction (in a "longitudinal direction" that will be described later) (see FIG. 7A). In the example illustrated in FIGS. 7A and 7B, teeth having different tip end R are provided in the lower teeth 520 as in the first tooth row 520A and the second tooth row 520B, but may be provided in the upper teeth 510 as illustrated in FIGS. 6A and 6B. Further, such teeth may be provided to both the upper and lower teeth 510 and 520 (a fourth exemplary embodiment to be described later). That is, at least one of the upper teeth 510 and the lower teeth 520 may be provided with the characteristic configuration of the present exemplary embodiment.

In the present exemplary embodiment, the positional relationship of the inclined surfaces is not changed in the first and second tooth forms. That is, the heights of teeth are changed in the first and second tooth forms, but the angle of the inclined surfaces of the teeth and a pitch between teeth are not changed.

In addition, since the sheets P are pulled and extended by elongation of the sheets P of adjoining teeth, it is difficult to obtain effects unless a plurality of teeth is continuously arranged. In the present exemplary embodiment, excellent results were obtained by continuously arranging four or more teeth, based on certain experimental results. The influence from the adjoining teeth is also found in other exemplary embodiments.

Figure 8:
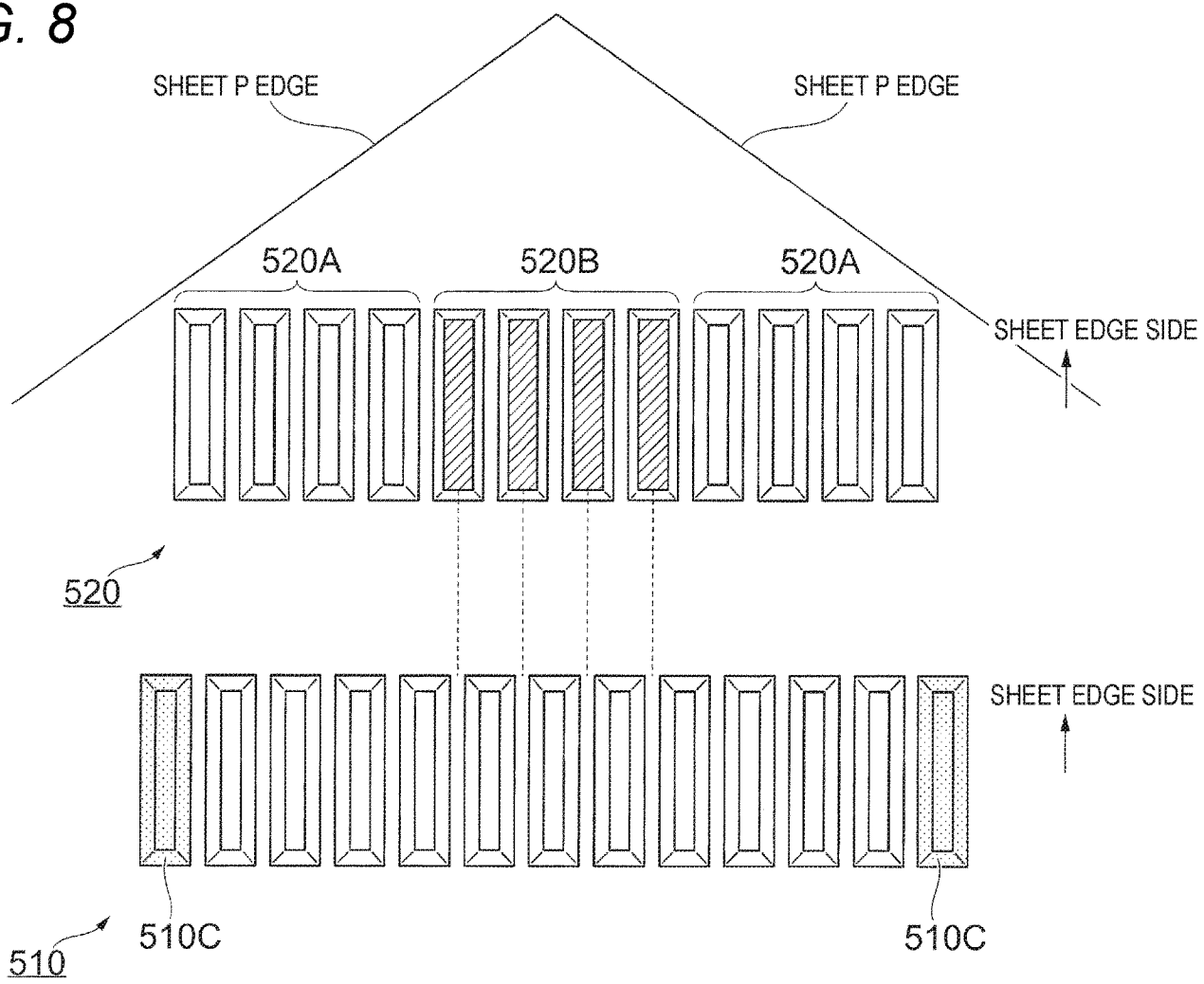
FIG. 8 is a view for describing a relationship between the lower teeth in a first exemplary embodiment illustrated in FIGS. 7A and 7B and upper teeth facing the lower teeth.

FIG. 8 is a view for describing a relationship between the lower teeth 520 and the upper teeth 510 facing the lower teeth 520 in the first exemplary embodiment illustrated in FIGS. 7A and 7B.

FIG. 8 illustrates the lower teeth 520 when viewed from the top side, and the upper teeth 510 when viewed from the bottom side. FIG. 8 illustrates an example in which the binding processing is carried out at position C of FIG. 3. The lower and upper teeth 520 and 510 have tooth rows in which plural teeth extending in one direction are aligned, around a corner of the sheet bundle B, that is, a position where edges of the sheet P intersect each other. FIGS. 8 to 14 illustrate the teeth in which the tip ends of the teeth are drawn by rectangular solid lines. However, such drawing is adopted for convenience to make a region clear and to facilitate understanding. When an tip end R such as a chamfer is provided, a line that is clear like the above solid lines does not appear.

In the lower teeth 520, two first tooth rows 520A are arranged with the second tooth row 520B being interposed therebetween. That is, the tooth row having a large tip end R to make the elongation amount of the sheets P small (second tooth row 520B) is located at the center. Teeth 510C, which do not exhibit a binding force, are arranged at both ends of the row of upper teeth 510. Other than the teeth 510C, teeth which has the same tooth form as the first tooth row 520A and have a small tip end R to make the elongation amount of the sheets P large, are arranged in the remaining portion. The lower teeth 520 and the upper teeth 510 alternately face each other such that the convex portions of the lower teeth 520 correspond to the concave portions of the upper teeth 510, respectively. With such an arrangement of the lower teeth 520 and the upper teeth 510, a good binding force for a large number of sheets (e.g., ten (10) sheets) becomes excellent in the region of the first tooth row 520A, and in this region, a binding force for a small number of sheets (e.g., two sheets) is minute. Meanwhile, in the region of the second tooth row 520B, a binding force for a small number of sheets (e.g., two (2) sheets) is excellent. In this region, it is impossible to obtain a binding force required for a large number of sheets (e.g., ten (10) sheets). However, according to the present exemplary embodiment, a binding member may be provided in which a paper P elongation amount region for a small number of sheets, of which the shape is determined to be suitable for a small number of sheets, and a paper P elongation amount region for a large number of sheets, of which the shape is determined to be suitable for a large number of sheets are arranged at a predetermined array number in a state where interference between adjoining teeth is reduced, and the binding for the small number of sheets and the binding for the large number of sheets can be simultaneously achieved by one binding operation.

In addition, the first exemplary embodiment illustrated in FIGS. 7 and 8 make the tooth lengths of the first tooth row 520A and the second tooth row 520B (lengths extending from one end side to the other end side) equal to each other. However, for example, the tooth length of the second tooth row 520B may be set to be long, compared to that of the first tooth row 520A. The teeth having the large tip end R (the teeth having a low height) are smaller in load than the teeth having the small tip end R (the teeth having a high height). When the area is increased in a low load portion, the load applied to one tooth becomes equal to that of the teeth having the small tip end R. Thus, the load can be uniformly applied to the entire tooth rows.

Second Exemplary Embodiment

Next, a second exemplary embodiment of the binding member, to which the present exemplary embodiment is applied, will be described.

Figure 9A:
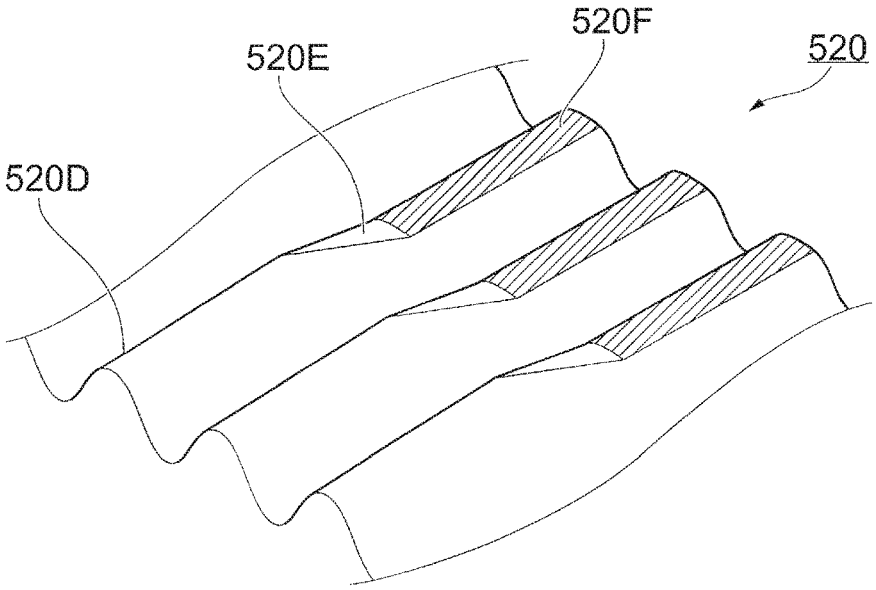
FIGS. 9A and 9B are views for describing a configuration of a binding member of a second exemplary embodiment.
Figure 9B:
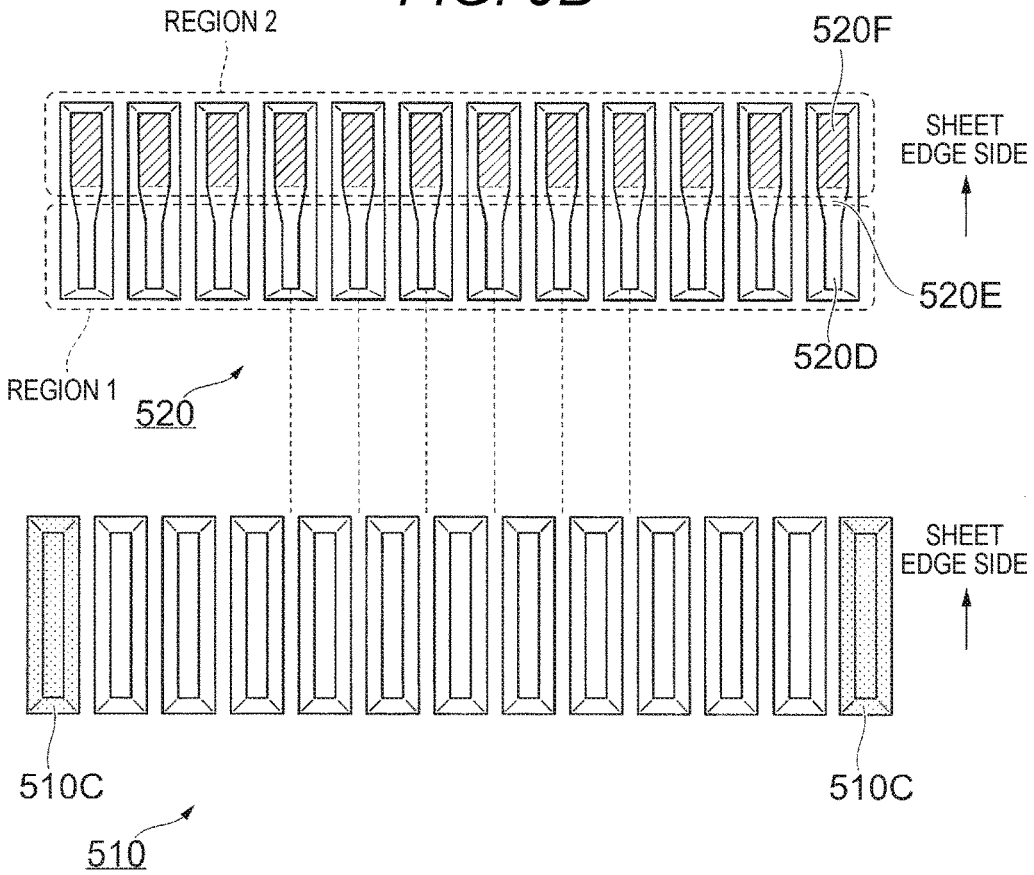

FIGS. 9A and 9B are views for describing the configuration of the binding member of the second exemplary embodiment, FIG. 9A is a perspective view of the lower teeth 520, and FIG. 9B is a view illustrating a relationship between the lower teeth 520 and the upper teeth 510 facing the lower teeth 520 in the second exemplary embodiment.

In the second exemplary embodiment, in at least one of the upper teeth 510 and the lower teeth 520, the surface length of the teeth is partially shortened without changing the positional relationship of the inclined surfaces of the teeth. In the example illustrated in FIGS. 9A and 9B, the surface length of only the lower teeth 520 is partially shortened, and such a shape change does not exist in the upper teeth 510. Here, the lower teeth include a first tooth form portion 520D that is small in tip end R and is long in surface length, a second tooth form portion 520F that is large in tip end R of the tooth and is short in surface length of the tooth in a state where only the tip end R of the tooth is cut from the first tooth form portion 520D, and a size transition portion 520E in which the size of the tip end R is changed. In the second exemplary embodiment, a difference elongation amount is imparted to the sheets P between one end side and the other end side of each tooth (in the longitudinal direction of the tooth). In the binding unit 50 of FIGS. 4A and 4B, a direction in which the tooth enters the sheet bundle B is referred to as one end. Therefore, in the present exemplary embodiment, a "sheet edge side" illustrated in the drawings becomes "the other end side". However, the one end side and the other end side are not especially meaningful in the terms thereof, and there will be no problem even if they are reversely used without affecting the interpretation of the invention.

In addition, in the second exemplary embodiment, as illustrated in FIG. 9B, all of the teeth as the lower teeth 520 have a difference in elongation amount of the sheets P between the one end side and the other end side of the teeth (in the longitudinal direction of the teeth). Each of the lower teeth 520 has the first tooth form portion 520D and the second tooth form portion 520F. However, the teeth are continuously arranged in a line. In the region 1 where the first tooth form portions 520D are continuously arranged, the elongation amount of the sheets P is increased such that the sheet bundle B having a large number of sheets (e.g., 10 sheets) is excellently bound. Meanwhile, in the region 2 where the second tooth form portions 520F are continuously arranged, the elongation amount is reduced compared to the first tooth form portions 520D such that the sheet bundle B having a small number of sheets (e.g., two (2) sheets) is excellently bound. In the upper teeth 510, teeth are used in which the tip end R of the same tooth as the first tooth form portion 520D is small and the surface length of the tooth is long. At the opposite ends of the row of upper teeth 510, teeth 510C that does not apply a binding force are arranged. According to the second exemplary embodiment, the binding of a large number of sheets can be excellently performed by the region 1, and the binding of a small number of sheets can be excellently performed by the region 2. That is, for example, with a single operation of the binding unit 50, the sheet bundles B ranging from a small number of sheets (e.g., two (2) sheets) to a large number of sheets (e.g., ten (10) sheets) may be excellently bound in the regions 1 and 2.

Third Exemplary Embodiment

Next, a third exemplary embodiment of the binding member to which the present exemplary embodiment is applied will be described.

Figure 10:
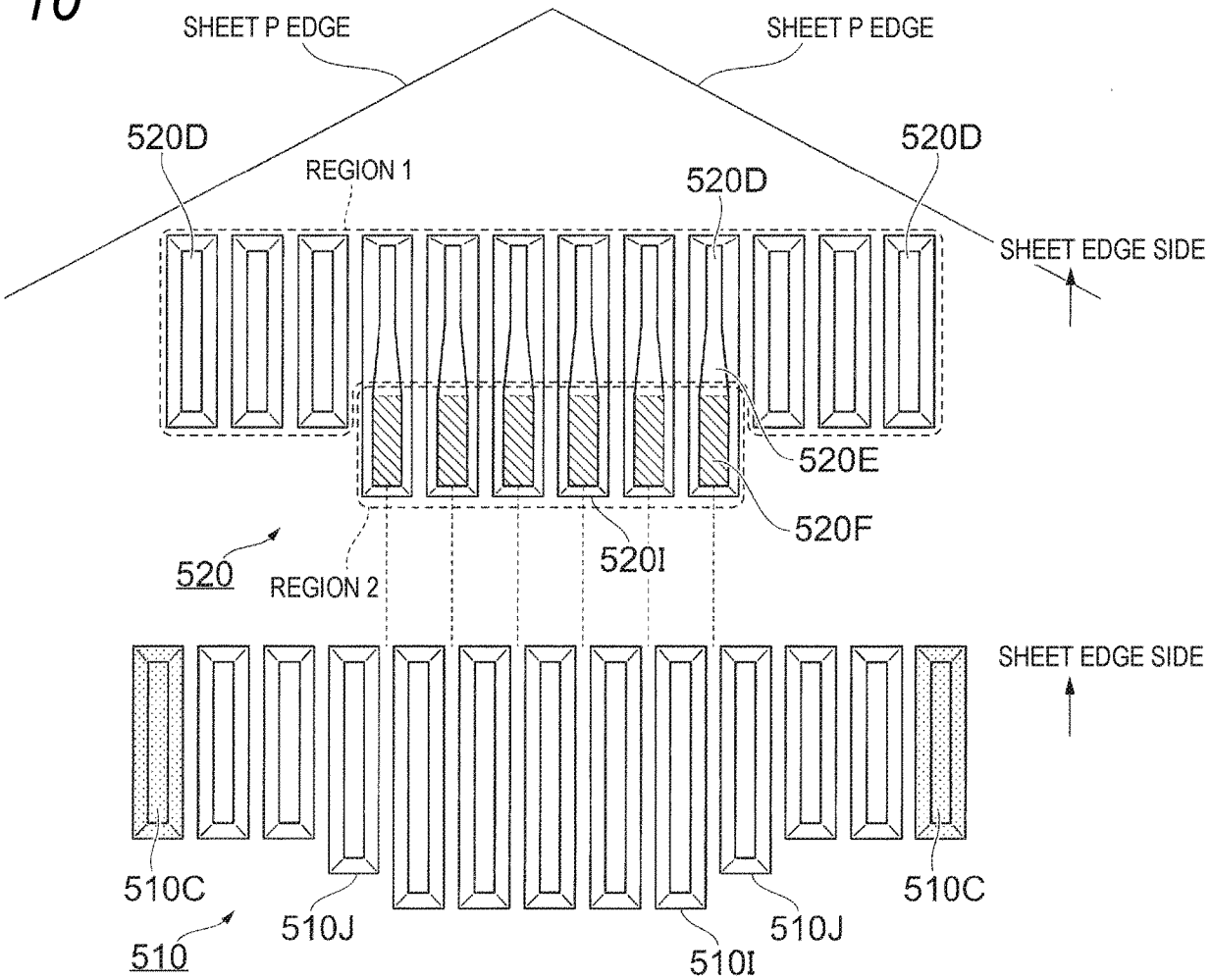
FIG. 10 is a view for describing a configuration of a binding member of a third exemplary embodiment.

FIG. 10 is a view for describing the configuration of the binding member of the third exemplary embodiment. In the example illustrated in FIG. 10, the length of teeth extending in one direction in teeth 520I constituting a tooth row of the central portion of the lower teeth 520 is long. When the length of the entire teeth is set to be long, the load required for binding is also increased. Thus, in the third exemplary embodiment, only the teeth 520I present in the central portion are set to be long in the longitudinal direction. In addition, in the portion where the tooth length of the teeth 520I is set to be long, the third exemplary embodiment includes second tooth form portions 520F, each of which has a large tip end R of the tooth and a short surface length of the tooth in a state where only the tip end R is cut from the first tooth form portion 520D and a size transition portion 520E in which the size of the tip end R is changed. That is, in the teeth 520I constituting the tooth row of the central portion, a difference in the elongation amount of the sheets P are imparted between one end side and the other end side of the tooth (the edge side of the sheet and the other side, the longitudinal direction of the tooth).

In the third exemplary embodiment, in the lower teeth 520, the second tooth form portions 520F are provided in a region where the teeth 520I present in the central portion of the lower teeth 520 are set to be long in the longitudinal direction, and the teeth 520I are continuously arranged, thereby forming the region 2 in which the bonding for the sheet bundle B having a small number of sheets (e.g., two (2) sheets) is excellent. In the region 1 other than the region 2, where the first tooth form portions 520D are continuously arranged, the elongation amount of the sheets P is increased so that the sheet bundle B having a large number of sheets (e.g., ten (10) sheets) is excellently bound. In the upper teeth 510, teeth are used in which the tip end R of the teeth having the same tooth form as the first tooth form portion 520D is small and the surface length of the teeth is long. Teeth 510I, of which the length in the longitudinal direction is set to be long, are arranged In the upper teeth 510 facing the tooth 520I of the lower teeth 520. Further, teeth 510J having a moderate length are disposed in the upper teeth 510 at the positions facing the lower teeth 520 in the vicinity of both ends of the region 2 of the lower teeth 520, so as to suppress the sheets P from being rapidly extended. Moreover, teeth 510C, which do not apply a binding force, are arranged on both ends of the row of upper teeth 510.

As in the first exemplary embodiment illustrated in FIGS. 7 and 8, the third exemplary embodiment includes a first tooth row, which is a row of teeth having a first tooth form, of which the shape is determined to be suitable for a large number of sheets (the first binding number of sheets), and a second tooth row, which is a row of teeth having a second tooth form, of which the shape is determined to be suitable for a small number of sheets (the second binding number of sheets). Further, as in the second exemplary embodiment illustrated in FIGS. 9A and 9B, the third exemplary embodiment adopts a technique that imparts a difference in elongation amount of the sheets P forming the sheet bundle B between the one end side and the other end side of each of the teeth constituting the tooth row.

In addition, in the example illustrated in FIG. 10, the teeth 520I in the central portion are set to be long in the longitudinal direction. However, the entire teeth may be set to have substantially the same length in the longitudinal direction, for example, by setting the teeth in the region 1 where the elongation amount of sheets is large, to be long, or by adjusting the teeth 520I in the central portion to match with the length of the region 1.

Figure 11:
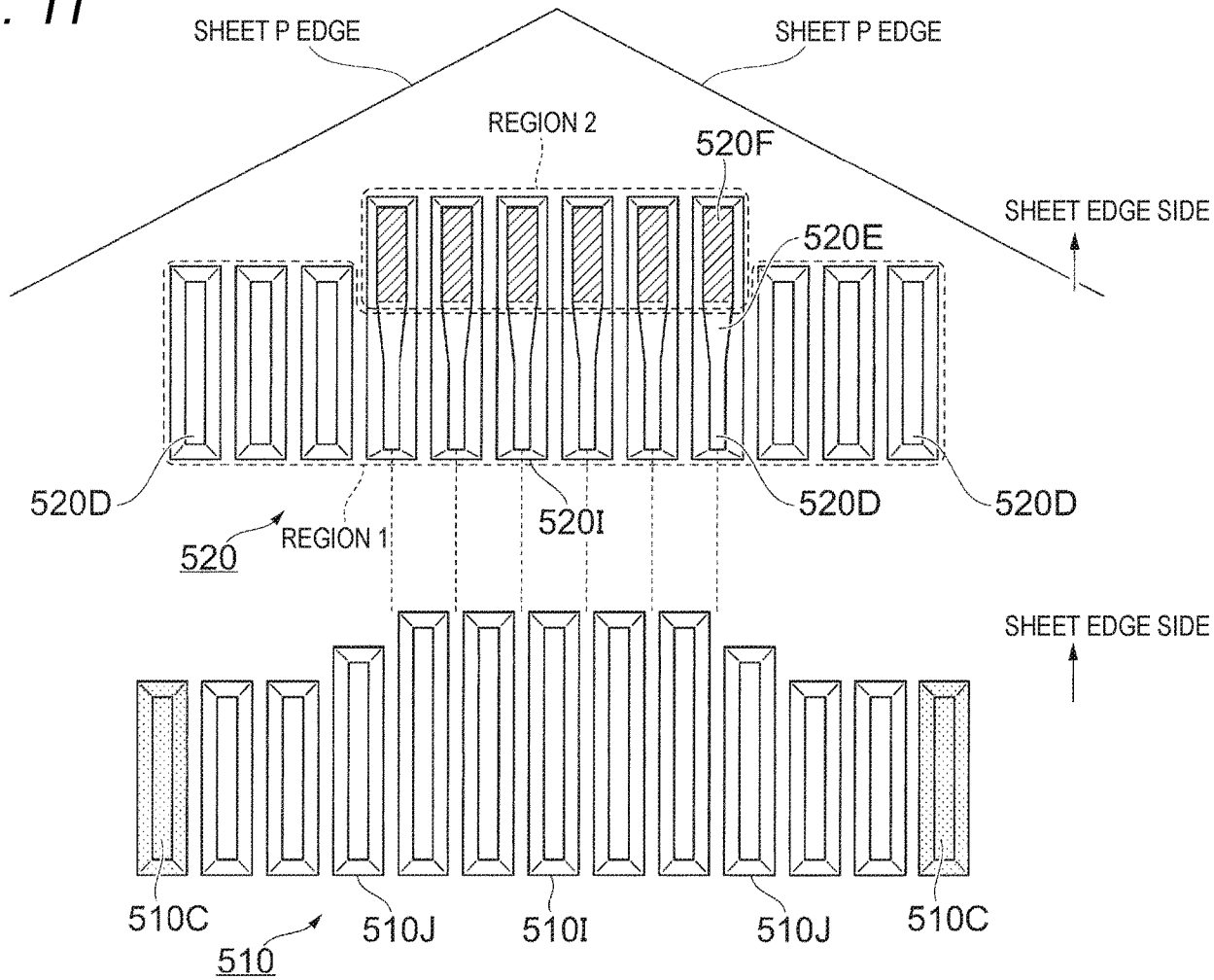
FIG. 11 is a view for describing another configuration example of the third exemplary embodiment.

FIG. 11 is a view for describing another configuration example of the third exemplary embodiment. In the example illustrated in FIG. 11, the region 2 where the teeth 520I having the second tooth form portions 520F for a small number of sheets are arranged is formed to protrude towards an edge side of the sheet P, which is in a reverse relation with the binding member of FIG. 10. Further, the above-described examples are different from each other in terms of the directions of the second tooth form portions 520F in the teeth 520I. When a person turns the bound sheet bundle B, a manipulation may be performed from a central side (lower side of drawing) towards the edge of the sheet P. The region 2 in which the sheet bundle B having a small number of sheets (e.g., two (2) sheets) is excellently bound is provided around the edge of the sheet P, so that the load of the turning manipulation is applied to a portion bound by the region 2 in addition to the portion bound by the region 1. Therefore, load applied to the sheet bundle B having a small number of sheets is mitigated.

Figure 12:
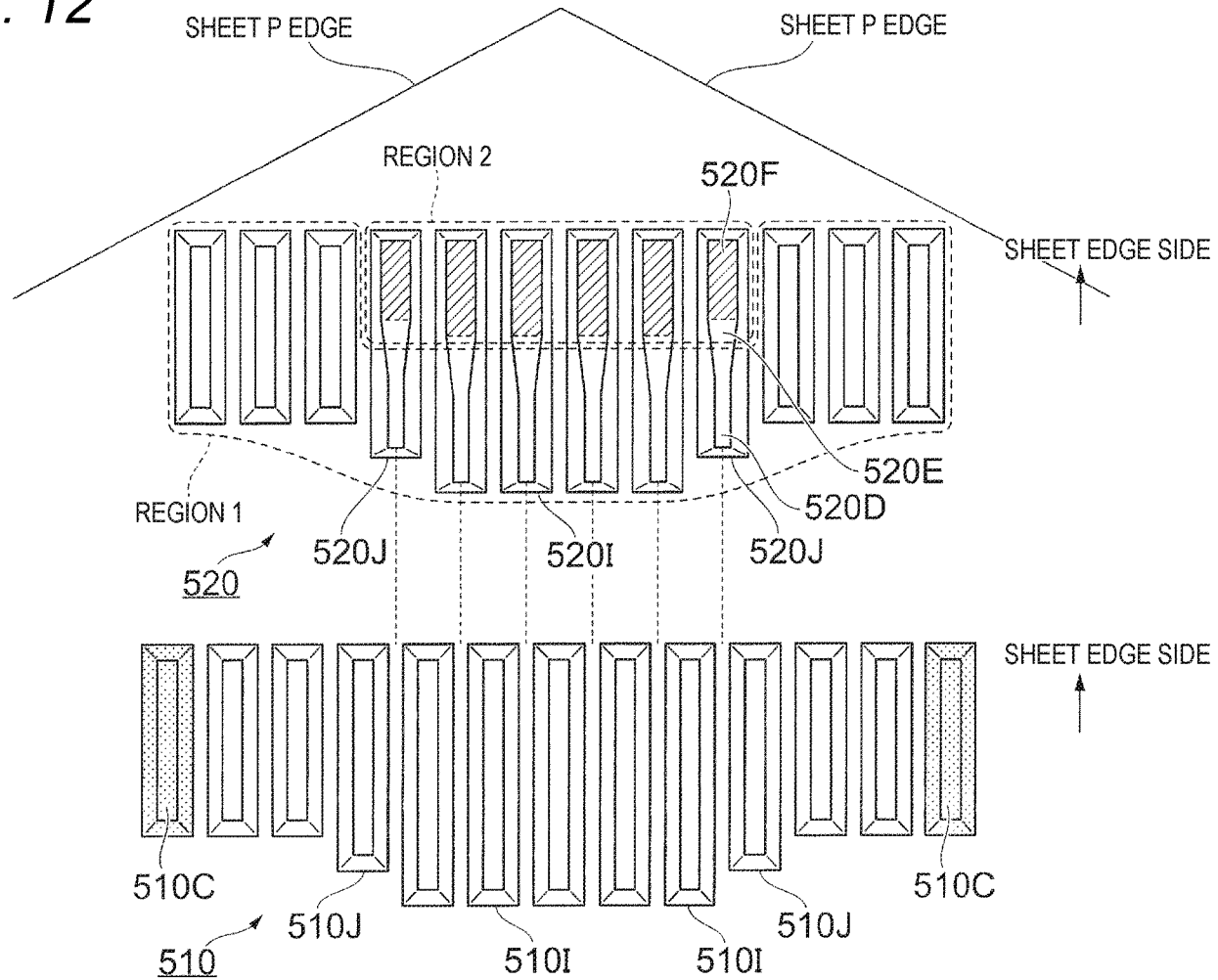
FIG. 12 is a view for describing another configuration example of the third exemplary embodiment.

FIG. 12 is a view for describing still another configuration example of the third exemplary embodiment. The example illustrated in FIG. 12 is different from the binding member illustrated in FIG. 11 in that the region 2 where the teeth 520I obtaining a binding force for binding a small number of sheets (e.g., two (2) sheets) by the second tooth form portions 520F are arranged is swollen in a mountain shape toward a direction opposite to the edge of the sheet P. That is, on the opposite ends of the tooth row constituting the region 2, teeth 520J having a moderate length in the longitudinal direction are arranged. The moderate length is slightly shorter than teeth 520I that are set to be long in the longitudinal direction. As a result, the region 2 suitable for binding a small number of sheets is formed in an arch shape. By forming the region 2 in this way, it is easy to deform the sheets P in the sheet bundle B having a small number of sheets. Further, in the upper teeth 510, the extending direction of the teeth 510I set to be long in the longitudinal direction and the teeth 510J having moderate length is aligned with the extending direction of the teeth 520I and 520J of the lower teeth 520.

Figure 13:
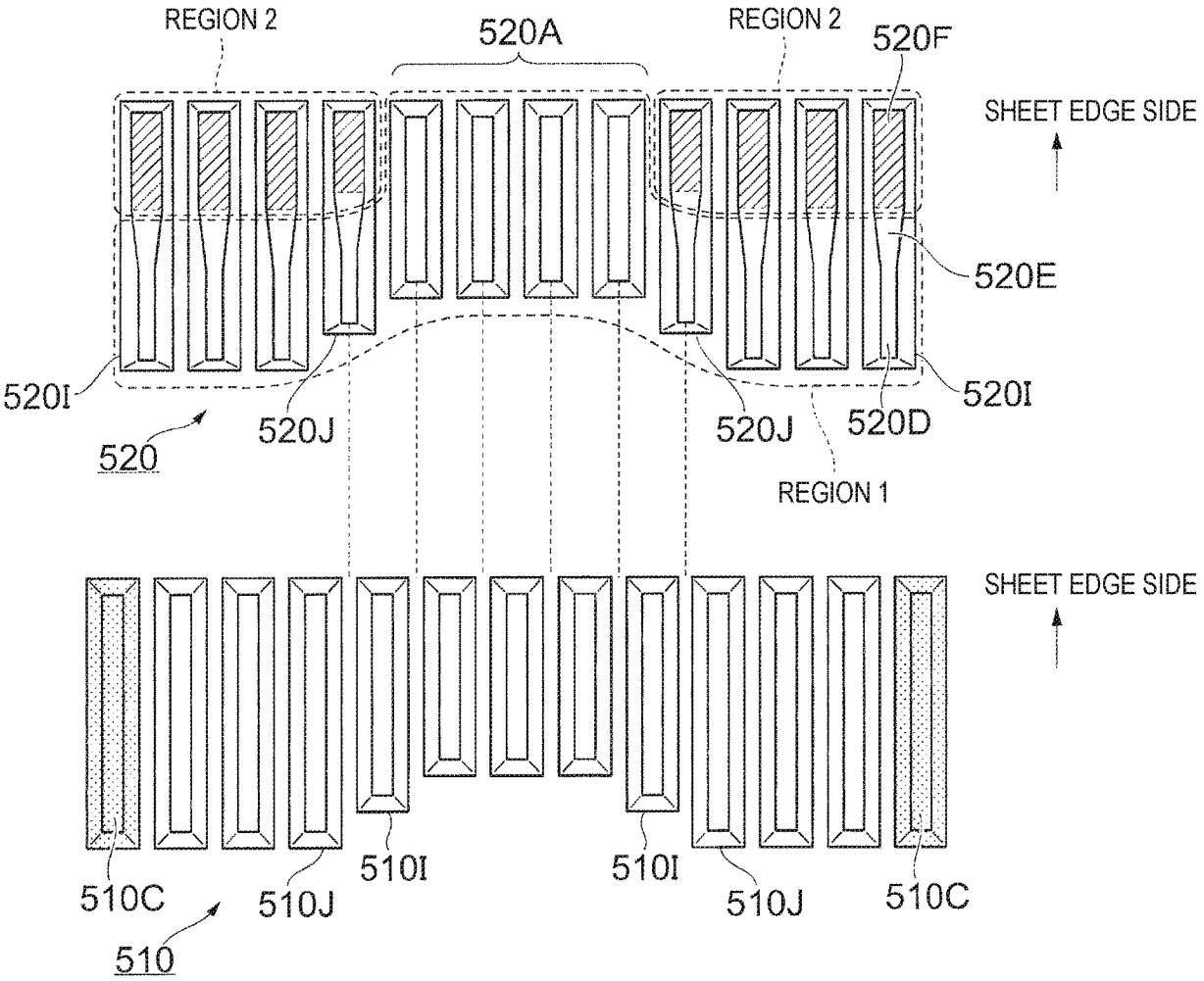
FIG. 13 is a view for describing still another configuration example of the third exemplary embodiment.

FIG. 13 is a view for describing still another configuration example of the third exemplary embodiment. In the example illustrated in FIG. 13, regions 2 where the teeth 520I configured to obtain a binding force for binding a small number of sheets (e.g., two (2) sheets) by the second tooth form portions 520F are arranged are provided to be dispersed on opposite sides of the row of the lower teeth 520. That is, the regions 2 obtaining a binding force for binding a small number of sheets (e.g., two (2) sheets) are separately located at two positions. The regions may be separately located at any other position in addition to the two positions (i.e., at two or more positions). In the tooth row constituting the region 2, teeth 520J set to be short in longitudinal length, compared to the teeth 520I set to be long in the longitudinal direction are arranged at a position adjacent to the first tooth row 520A. According to the extension of the lower teeth 520 in the longitudinal direction, in the upper teeth 510, the teeth facing the lower teeth similarly extend. Further, on opposite ends of the row of upper teeth 510, teeth 510C, which do not apply a binding force, are arranged as in the other configuration examples.

Fourth Exemplary Embodiment

Next, a fourth exemplary embodiment of the binding member to which the present exemplary embodiment is applied will be described.

Figure 14:
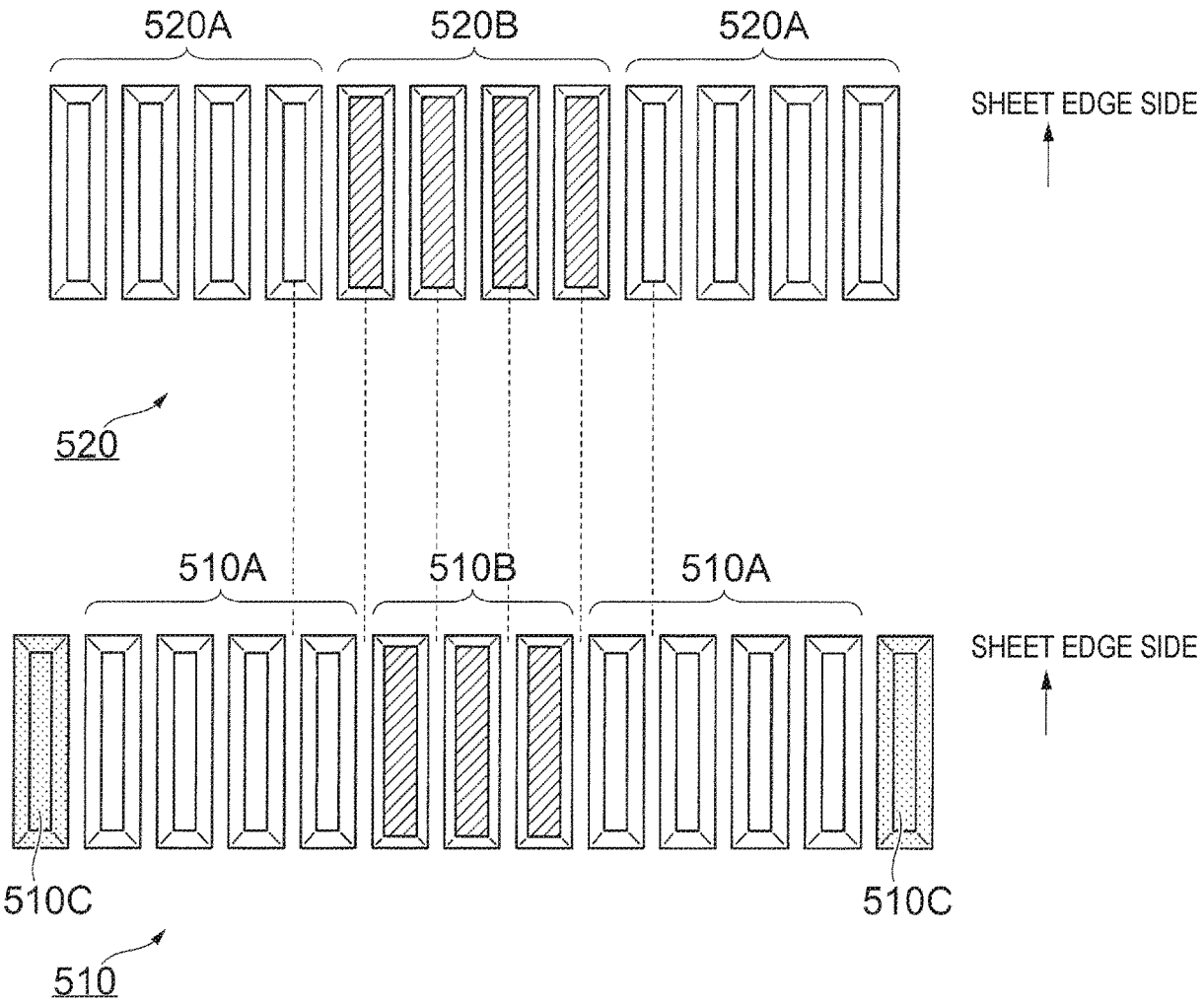
FIG. 14 is a view for describing a configuration of a binding member of a fourth exemplary embodiment.

FIG. 14 is a view for describing a configuration of the binding member of the fourth exemplary embodiment. In the fourth exemplary embodiment, upper and lower teeth 510 and 520 have different tooth forms for adjusting the elongation amount of sheets.

The configuration of the lower teeth 520 remains the same as the first exemplary embodiment of FIG. 8. In the fourth exemplary embodiment, as the upper teeth 510, a second tooth row 510B is disposed to be interposed between two first tooth rows 510A. That is, the tooth row (second tooth row 510B) having the large tip end R is placed in a center to make the elongation amount of the sheet P small. The tooth form of the teeth constituting the second tooth row 510B have the same positional relationship of the inclined surfaces as the teeth constituting the first tooth row 510A, but the height of the teeth is lowered and the tip end R of the teeth is enlarged to shorten the surface length of the teeth such that an excellent bonding can be formed for a sheet bundle B having a small number of sheets.

Further, teeth 510C, which do not apply a binding force, are arranged on opposite ends of the row of upper teeth 510, as in the other configuration examples.

Fifth Exemplary Embodiment

Next, a fifth exemplary embodiment of the binding member to which the present exemplary embodiment is applied will be described.

Figure 15A:
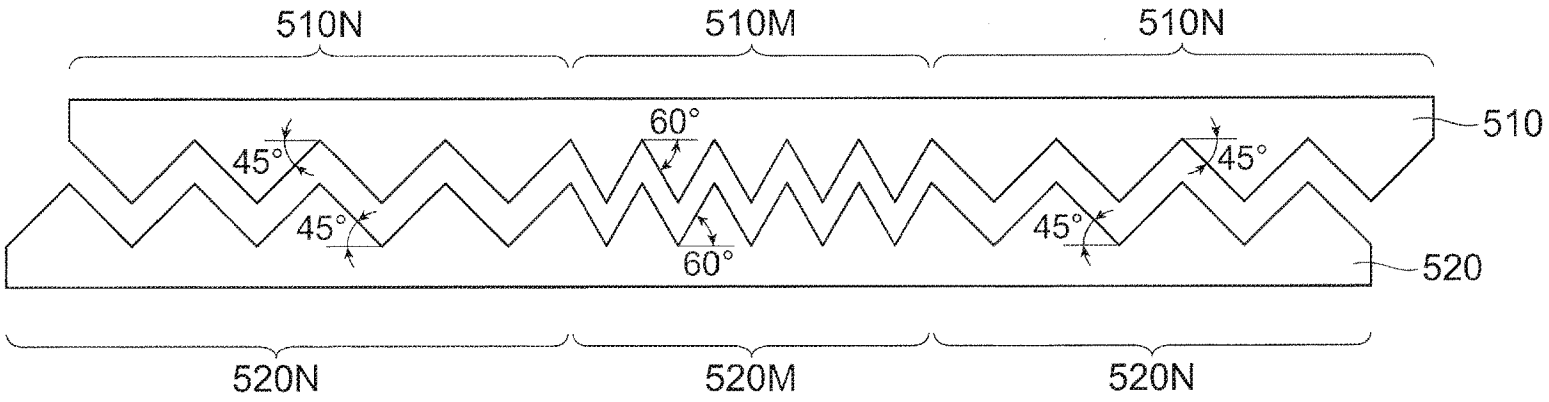
FIGS. 15A and 15B are views for describing a binding member of a fifth exemplary embodiment.
Figure 15B:
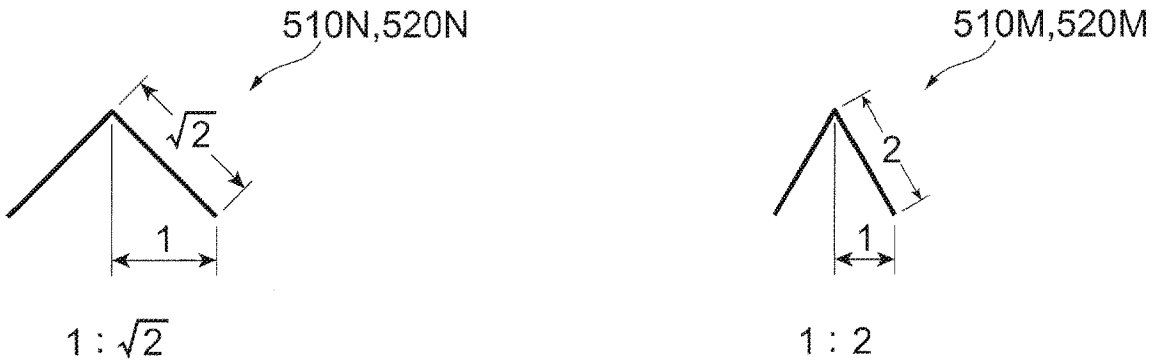

FIGS. 15A and 15B are views for describing the binding member of the fifth exemplary embodiment. In the fifth exemplary embodiment, the positional relationship of the inclined surfaces of the teeth constituting the tooth row is changed to provide a difference in elongation amount for the sheets P. That is, with the first and second forms, the angle of the inclined surfaces of the teeth and the pitch between the teeth are changed so that the positional relationship of the inclined surfaces of the teeth constituting the tooth row is changed. The present exemplary embodiment is different from the other exemplary embodiments in that the positional relationship of the inclined surfaces of the teeth is not changed in the first to fourth exemplary embodiments, while the positional relationship of the inclined surfaces of the teeth is changed in the present exemplary embodiment.

Since the positional relationship of the inclined surfaces of the teeth is changed, the tooth forms are changed in both of the upper teeth 510 and the lower teeth 520 such that the upper teeth 510 and the lower teeth 520 have the same features, respectively.

The binding members to which the present exemplary embodiment is applied include first tooth rows 510M and 520M having a first tooth form in which a positional relationship of inclined surfaces is determined to be suitable for the first binding number of sheets (i.e., a first positional relationship suitable for binding a first binding number of sheets), and second tooth rows 510N and 520N having a second tooth form in which a positional relationship of inclined surfaces to be suitable for the second binding number of sheets (i.e., a second positional relationship suitable for binding a second binding number of sheets) which is smaller than the first binding number of sheets. As the first binding number of sheets of a sheet bundle B, for example, 6 to 10 sheets may be selected, while as the second binding number of sheets of the sheet bundle B, for example 2 to 5 sheets may be selected.

Compared to the first tooth form constituting the first tooth rows 510M and 520M, the second tooth form constituting the second tooth row 510N and 520N has a gentle angle in the inclined surfaces of the teeth. More specifically, for example, the first tooth form is cut to be raised at 60 degrees from a horizontal, and the second tooth is cut to be raised at 45 degrees from the horizontal. As illustrated in FIG. 5B, in the first tooth form constituting the first tooth rows 510M and 520M, the sheet P is elongated by a ratio of 2 in relation to a distance of 1, and in the second tooth form constituting the second tooth rows 510N and 520N, the sheet P is elongated by a ratio of $\sqrt{2}$ (root 2) in relation to a distance of 1. That is, the elongation of the sheet P elongated in the first tooth rows 510M and 520M becomes long, while the elongation of the sheet P extends elongated in the second tooth rows 510N and 520N becomes short.

In the fifth exemplary embodiment, although the positional relationship of the inclined surfaces is changed, a sheet bundle B almost simultaneously comes into contact with the inclined surfaces of the first tooth rows 510M and 520M and the inclined surfaces of the second tooth rows 510N and 520N when convex and concave portions are formed on the sheet bundle B by the upper and lower teeth 510 and 520. When the sheet bundle B has a small number of sheets (e.g., 2 to 5 sheets), the sheet bundle B is subjected to an appropriately short elongation by the second tooth rows 510N and 520N having a low elongation rate, so that excellent binding is realized. On the other hand, when the sheet bundle B has a large number of sheets (e.g., 6 to 10 sheets), an appropriately long elongation can be achieved by the second tooth rows 510M and 520M having a high elongation rate, so that excellent binding is realized. In order to increase the entire elongation amount, the number of teeth may be increased, and in order to reduce the entire elongation amount, the number of teeth may be reduced.

Further, for the second tooth rows 510N and 520N of the fifth exemplary embodiment, the height of the teeth may be lowered and the surface length of the teeth may be shortened in order to further reduce the elongation amount, as in the second tooth row 520B of the first exemplary embodiment illustrated in FIGS. 7A and 7B. In this case, it is possible to adopt a configuration in which the tooth height is lowered in at least one of the second tooth row 510N of the upper teeth 510 and the second tooth row 520N of the lower teeth 520.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding member comprising:

upper teeth having a tooth form configured to form a convex-concave portion on a recording material bundle; and lower teeth having a tooth form configured to form the convex-concave portion on the recording material bundle, wherein at least one of the upper teeth and the lower teeth includes:

a first tooth row having a first tooth form having a first shape suitable for binding a first binding number of sheets; and a second tooth row having a second tooth form having a second shape suitable for binding a second binding number of sheets which is smaller than the first binding number of sheets, and wherein the second tooth row is configured such that elongation of the recording material bundle is less than or equal to 18%.

2. The binding member according to claim 1, wherein the second tooth form has a tooth surface length shorter than the first tooth form without changing a positional relationship of inclined surfaces of teeth form from the first tooth form.

3. The binding member according to claim 1, wherein each of the first tooth row and the second tooth row includes four or more continuous teeth.

4. A binding member comprising:

upper teeth having a tooth form configured to form a convex-concave portion on a recording material bundle; and lower teeth having a tooth form configured to form the convex-concave portion on the recording material bundle, wherein at least one of the upper teeth and the lower teeth has a tooth surface length that is partially shortened without changing a positional relationship of inclined surfaces of teeth, wherein at least one of the upper teeth and the lower teeth includes a first tooth row and a second tooth row, and wherein the second tooth row is configured such that elongation of the recording material bundle is less than or equal to 18%.

5. The binding member according to claim 4, wherein the second tooth row has a tooth surface length shorter than the first tooth row.

6. The binding member according to claim 4, wherein the binding member includes a tooth form constituting at least one of the upper teeth and the lower teeth, and in a tooth extending in one direction in the tooth form, a surface length is shorter at one end side of the tooth, compared to the other end side of the tooth.

7. The binding member according to claim 6, wherein at least one of the upper teeth and the lower teeth includes a tooth row having a tooth form in which, in a tooth extending in one direction, a surface length is shorter at one end side of the tooth, compared to the other end side of the tooth, and a tooth row having a tooth form in which the surface length is not changed from one end side to the other end side.

8. The binding member according to claim 7, wherein the tooth row having the tooth form in which the surface length at the one end side is shorter compared to the other end side is longer in length of the tooth extending in the one direction, compared to the tooth row having the tooth in which the surface length is not changed from one end side to the other end side.

9. A binding apparatus comprising:

a holding section configured to hold a recording material bundle; and a binding member including a pair of upper teeth and lower teeth, the binding member being configured to form a convex-concave portion on the recording material bundle held by the holding section, with the upper teeth and the lower teeth, so as to perform binding processing, wherein, when performing the binding processing by the upper teeth and the lower teeth, the binding member provides a difference in elongation amount of a recording material forming the recording material bundle between one end side and the other end side of every tooth row, or between one end side and the other end side of a tooth constituting the tooth row, wherein at least one of the upper teeth and the lower teeth includes:

a first tooth row; and a second tooth row, and wherein the second tooth row is configured such that elongation of the recording material bundle is less than or equal to 18%.

10. The binding apparatus according to claim 9, wherein the binding member provides the difference in elongation amount of the recording material by partially changing a surface length of a tooth without changing a positional relationship of inclined surfaces of teeth, for at least one of the upper teeth and the lower teeth.

11. The binding apparatus according to claim 9, wherein the binding member provides the difference in elongation amount of the recording material by changing angles of the inclined surfaces of teeth in every tooth row in relation to the upper teeth and the lower teeth.

12. An image processing system comprising:

an image forming section configured to form an image on a recording material; and a binding section configured to form a convex-concave portion on a bundle of the recording material formed with the image by the image forming section, with a pair of upper teeth and lower teeth, so as to perform binding processing, wherein, the binding section is configured such that, when performing the binding processing by the upper teeth and the lower teeth, the binding section provides a difference in elongation amount of a recording material forming the recording material bundle between one end side and the other end side of every tooth row, or between one end side and the other end side of a tooth constituting the tooth row, wherein at least one of the upper teeth and the lower teeth includes:

a first tooth row; and a second tooth row, and wherein the second tooth row is configured such that elongation of the recording material bundle is less than or equal to 18%.

13. A binding member comprising:

upper teeth having a tooth form configured to form a convex-concave portion on a recording material bundle; and lower teeth having a tooth form configured to form the convex-concave portion on the recording material bundle, wherein at least one of the upper teeth and the lower teeth includes:

a first tooth row having a first tooth form having a first shape suitable for binding a first binding number of sheets; and a second tooth row having a second tooth form having a second shape suitable for binding a second binding number of sheets which is smaller than the first binding number of sheets, wherein the at least one of the upper teeth and the lower teeth further includes a third tooth row having the first tooth form having the first shape suitable for binding the first binding number of sheets, wherein teeth of the first tooth row and teeth of the third row have a first height from one end side to the other end side of the teeth in a longitudinal direction of the teeth, wherein teeth of the second tooth row have a second height from one end side to the other end side of the teeth in a longitudinal direction of the teeth, wherein the first height is greater than the second height, wherein the second tooth row is interposed between the first tooth row and the third row, and wherein the first shape and the second shape both comprise a rounded-shaped tip end.

* * * * *